US011687013B2

(12) United States Patent
Sugiyama et al.

(10) Patent No.: US 11,687,013 B2
(45) Date of Patent: Jun. 27, 2023

(54) TONER FOR ELECTROSTATIC CHARGE IMAGE DEVELOPMENT, TONER STORED UNIT, IMAGE FORMING APPARATUS, AND IMAGE FORMING METHOD

(71) Applicant: RICOH COMPANY, LTD., Tokyo (JP)

(72) Inventors: Toshihiko Sugiyama, Shizuoka (JP); Minoru Masuda, Shizuoka (JP); Yuka Mizoguchi, Shizuoka (JP); Hideki Sugiura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 139 days.

(21) Appl. No.: 17/076,990

(22) Filed: Oct. 22, 2020

(65) Prior Publication Data

US 2021/0124281 A1 Apr. 29, 2021

(30) Foreign Application Priority Data

Oct. 29, 2019 (JP) ..... 2019-196608

(51) Int. Cl.
*G03G 9/08* (2006.01)
*G03G 9/087* (2006.01)
*G03G 15/08* (2006.01)

(52) U.S. Cl.
CPC ..... *G03G 9/0821* (2013.01); *G03G 9/0819* (2013.01); *G03G 9/0825* (2013.01); *G03G 9/08755* (2013.01); *G03G 15/0865* (2013.01)

(58) Field of Classification Search
CPC .. G03G 9/0821; G03G 9/0819; G03G 9/0825; G03G 9/08755; G03G 9/0865
See application file for complete search history.

(56) References Cited

U.S. PATENT DOCUMENTS

| | | | | |
|---|---|---|---|---|
| 9,494,886 | B2 | 11/2016 | Kumai et al. | |
| 2012/0015292 | A1* | 1/2012 | Andaya | G03G 9/081 430/137.14 |
| 2013/0244163 | A1 | 9/2013 | Sato et al. | |
| 2015/0072286 | A1* | 3/2015 | Kumai | G03G 9/08755 430/109.4 |
| 2015/0268574 | A1* | 9/2015 | Miyaake | C08G 81/00 525/440.16 |
| 2016/0070191 | A1 | 3/2016 | Kumai et al. | |
| 2016/0091812 | A1* | 3/2016 | Makabe | G03G 9/08793 430/105 |
| 2016/0209767 | A1* | 7/2016 | Nagata | G03G 9/0821 |

FOREIGN PATENT DOCUMENTS

| | | |
|---|---|---|
| JP | 2013-190552 | 9/2013 |
| JP | 2014-224980 | 12/2014 |
| JP | 2014-240944 | 12/2014 |

* cited by examiner

*Primary Examiner* — Peter L Vajda
*Assistant Examiner* — Boone Alexander Evans
(74) *Attorney, Agent, or Firm* — Grüneberg and Myers, PLLC

(57) ABSTRACT

A toner for electrostatic charge image development, wherein a spin-spin relaxation time of the toner at 90° C. is 0.30 msec or more but 1.50 msec or less, and a spin-spin relaxation time of the toner at 50° C. is 0.0185 msec or more but 0.0300 msec or less, the spin-spin relaxation time of the toner at 90° C. and the spin-spin relaxation time of the toner at 50° C. being obtained by Hahn echo method of pulse NMR analysis.

15 Claims, 2 Drawing Sheets

TONER FOR ELECTROSTATIC CHARGE IMAGE DEVELOPMENT, TONER STORED UNIT, IMAGE FORMING APPARATUS, AND IMAGE FORMING METHOD

CROSS-REFERENCE TO RELATED APPLICATIONS

The present application claims priority under 35 U.S.C. § 119 to Japanese Patent Application No. 2019-196608, filed Oct. 29, 2019. The contents of which are incorporated herein by reference in their entirety.

BACKGROUND OF THE INVENTION

Field of the Invention

The present disclosure relates to a toner for electrostatic charge image development, a toner stored unit, an image forming apparatus, and an image forming method.

Description of the Related Art

In an image forming apparatus such as an electrophotographic apparatus or an electrostatic recording apparatus, an electrostatic latent image formed on a photoconductor is developed using a toner to form a toner image, the toner image is transferred onto a recording medium such as paper, and is fixed by heat to form an image. When a full color image is formed, four color toners such as black, yellow, magenta, and cyan are generally used for development. At this time, after toner images of the respective colors are transferred and overlapped on the recording medium, they are fixed by heat at the same time. For the purpose of achieving low power consumption and shortened warm-up time, a toner having low-temperature fixability has been investigated. However, a toner having a low melting point has poor cleaning ability. Therefore, there is a need for achieving them.

For example, in Japanese Unexamined Patent Application Publication No. 2014-224980, achievement of low-temperature fixability and heat resistant storage stability has been attempted by optimizing balance between an amount of a crystalline resin and a thickness of a shell.

For example, in Japanese Unexamined Patent Application Publication No. 2013-190552, prevention of cleaning failure has been attempted by optimizing a shape of a toner and kinds of additives.

SUMMARY OF THE INVENTION

According to one aspect of the present disclosure, a toner for electrostatic charge image development is provided. A spin-spin relaxation time of the toner at 90° C. is 0.30 msec or more but 1.50 msec or less. A spin-spin relaxation time of the toner at 50° C. is 0.0185 msec or more but 0.0300 msec or less. The spin-spin relaxation time of the toner at 90° C. and the spin-spin relaxation time of the toner at 50° C. are obtained by Hahn echo method of pulse NMR analysis.

DETAILED DESCRIPTION OF THE INVENTION (Toner for Electrostatic Charge Image Development)

Regarding a toner for electrostatic charge image development of the present disclosure, a spin-spin relaxation time of the toner at 90° C. is 0.30 msec or more but 1.50 msec or less, and a spin-spin relaxation time of the toner at 50° C. is 0.0185 msec or more but 0.0300 msec or less. The spin-spin relaxation time of the toner at 90° C. and the spin-spin relaxation time of the toner at 50° C. are obtained by Hahn echo method of pulse NMR analysis.

The toner for electrostatic charge image development of the present disclosure preferably includes at least one selected from the group consisting of a non-crystalline polyester resin and a crystalline polyester resin, and further includes a release agent and a colorant if necessary.

Figure 1:
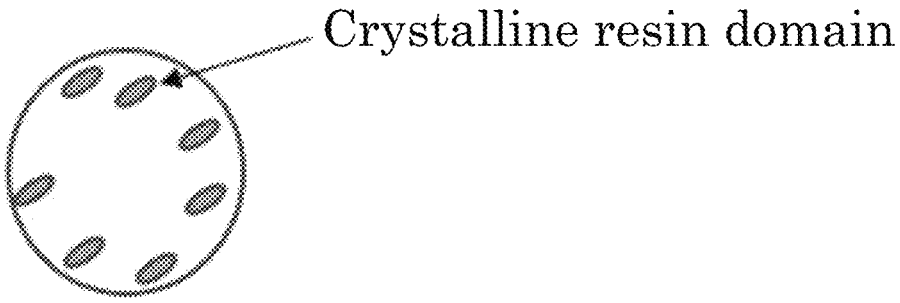
FIG. 1 is a schematic view of a cross section of a toner.

In order to provide a toner for electrostatic charge image development that can satisfy prevention of cleaning failure and low-temperature fixability, the present inventors diligently performed studies. As a result, they found that the following two points are important in order to achieve sufficient phase separation of a crystalline resin and a non-crystalline resin in the toner and to homogeneously disperse the crystalline resin in the form of fine domains, in the combination in which the crystalline resin and the non-crystalline resin are compatible. FIG. 1 presents a schematic view of a cross section of a toner.

First, fine crystalline resin domains are homogeneously dispersed in a matrix structure in which the crystalline resin and the non-crystalline resin are compatible in a toner or a resin composition constituting the toner.

Second, the toner resin is subjected to an annealing treatment, crystalline growth of the crystalline resin encapsulated in the toner resin is promoted to thereby form phase separation structure of the crystalline resin and the non-crystalline resin.

Specifically, the present inventors found that it is important for the production step of the toner to include the following steps.

(1) A step of homogeneously dispersing the crystalline polyester resin in the form of fine domains by LCP.

(Details of the LCP will be Described Hereinafter.)

(2) A step of forming phase separation structure of the crystalline resin and the non-crystalline resin at a certain rate after homogeneously blending the crystalline resin and the non-crystalline resin in the resin composition constituting the toner.

By performing these steps, it is possible to achieve sufficient phase separation of the crystalline resin and the non-crystalline resin and to form homogeneously dispersed fine domains in the toner or the resin composition constituting the toner. As a result, thermal behavior of the toner can be controlled. Therefore, the toner that can satisfy prevention of cleaning failure and low-temperature fixability can be obtained.

As a result of diligent studies performed by the present inventors, the thermal behavior of the toner that can satisfy prevention of cleaning failure and low-temperature fixability can be confirmed from spin-spin relaxation times obtained by the Hahn echo method of the pulse NMR analysis, and the present inventors completed the present disclosure.

An object of the present disclosure is to provide a toner for electrostatic charge image development that can satisfy low drawing temperature, prevention of cleaning failure, low-temperature fixability, and high maximum fixing temperature.

According to the present disclosure, it is possible to provide a toner for electrostatic charge image development that can satisfy low drawing temperature, prevention of cleaning failure, low-temperature fixability, and high in maximum fixing temperature.

That is, the toner of the present disclosure has the following characteristics. A spin-spin relaxation time of the toner at 90° C. is 0.30 msec or more but 1.5 msec or less, and a spin-spin relaxation time of the toner at 50° C. is 0.0185 msec or more but 0.0300 msec or less. Here, the spin-spin relaxation time of the toner at 90° C. and the spin-spin relaxation time of the toner at 50° C. are obtained by the Hahn echo method of the pulse NMR analysis.

When the spin-spin relaxation time of the toner at 90° C. is less than 0.30 msec, the low-temperature fixability is decreased. When the spin-spin relaxation time of the toner at 90° C. is more than 1.5 msec, the maximum fixing temperature becomes low. When the spin-spin relaxation time of the toner at 50° C. is less than 0.0185 msec, the minimum scratch temperature becomes high. When the spin-spin relaxation time of the toner at 50° C. is more than 0.0300 msec, the cleaning failure occurs.

The spin-spin relaxation time of the toner at 90° C. is preferably 1.0 msec or more but 1.5 msec or less in terms of the low-temperature fixability and a higher maximum fixing temperature.

The pin-spin relaxation time of the toner at 50° C. is preferably 0.0200 msec or more but 0.0250 msec or less in terms of the minimum scratch temperature.

The spin-spin relaxation time (t2) in the present disclosure is a characteristic value in which the thermal behavior of the toner is reflected. The toner is measured by the Hahn echo method of the pulse NMR analysis, and a spin-spin relaxation time calculated from the decay curve obtained is regarded as t2. The spin-spin relaxation time (t2) exhibits mobility of molecules constituting the toner. Therefore, hardness of the toner at a certain temperature can be evaluated. For example, when molecules constituting a toner having a low melting point are heated, a long spin-spin relaxation time (t2) is presented because of high mobility at the time of melting. In the case where fixability and prevention of cleaning failure are discussed, the important things are a temperature of melting behavior obtained when the toner passes through a fixing device and is heated, and behavior of the toner particles adhering to a photoconductor, a drum, or a cleaning part within an apparatus. Moreover, a thermal environment under which the toner is to be exposed varies depending on the respective cases. Therefore, in the present disclosure, the spin-spin relaxation time (t2) of the toner at 90° C. where the former case is considered, and the spin-spin relaxation time (t2) of the toner at 50° C. where the latter case is considered are evaluated.

<Pulse NMR Analysis>

In the present disclosure, the pulse NMR analysis of the toner is preferably performed by the following method. That is, a high frequency magnetic field as pulse is applied to a toner charged into an NMR tube using pulse NMR; Minispec mq series (available from Bruker), and the magnetization vector is rotated. Then, mobility of molecules constituting the toner is evaluated from times (=relaxation times) until which x and y components decay.

[1. Sample]

A toner (40 mg) is weighed and is charged into an NMR tube having a diameter of 10 mm. Then, the toner is heated for 15 minutes in a preheater in which the temperature is adjusted to 90° C., and is used for measurement. Note that, even in toners having the same temperature of 90° C., such a sample that is once heated to a temperature higher than 90° C. and is returned to 90° C. through cooling has significantly different characteristics because its crystalline state is drastically changed. Therefore, a temperature of the preheater is necessarily adjusted to 90° C., and then heating of the sample needs to be started.

[2. Measurement Condition]

Hahn echo method
First 90° Pulse Separation; 0.01 msec
Final Pulse Separation; 20 msec
Number of Data Point for Fitting; 40 points
Cumulated number; 32 times
Temperature; 90° C.

[3. Calculation Method of Spin-Spin Relaxation Time (t2)]

Using exponential approximation of ORIGIN 8.5 (available from Origin Lab), the spin-spin relaxation time (t2) is calculated from the decay curve obtained by the Hahn echo method of the pulse NMR measurement. It is known that as the molecular mobility is lower, the spin-spin relaxation time is shorter, and as the molecular mobility is higher, the spin-spin relaxation time is longer.

<Crystalline Polyester Resin>

The toner for electrostatic charge image development preferably includes a crystalline polyester resin.

A melting point of the crystalline polyester resin preferably falls within a range of 50° C. or more but 100° C. or less, more preferably a range of 55° C. or more but 90° C. or less, still more preferably a range of 55° C. or more but 85° C. or less.

When the melting point is 50° C. or more, blocking is not caused in a stored toner, and storage ability of the toner and storage ability of a fixed image after fixing become good. When the melting point is 100° C. or less, sufficient low-temperature fixability can be obtained.

Note that, the melting point of the crystalline polyester resin can be determined as a peak temperature of an endothermic peak obtained through differential scanning calorimetry (DSC).

The "crystalline polyester resin" in the present disclosure includes not only a polymer made of 100% of a polyester structure, but also a copolymer of a monomer constituting polyester and another monomer. However, the ratio of the another monomer in the copolymer is 50% by mass or less.

The crystalline polyester resin used in the toner of the present disclosure is synthesized from, for example, a polyvalent carboxylic acid component and a polyvalent alcohol component. The crystalline polyester resin may be a commercially available product or may be a synthesized product.

Examples of the polyvalent carboxylic acid component include bivalent carboxylic acid components and trivalent or higher carboxylic acid components.

Examples of the bivalent carboxylic acid component include: aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid (stearic acid); and aromatic dicarboxylic acids such as dibasic acids (e.g., phthalic acid, isophthalic acid, terephthalic acid, naphthalene-2,6-dicarboxylic acid, malonic acid, and mesakonin acid). Moreover, examples of the bivalent carboxylic acid component include anhydrides thereof and lower alkyl esters thereof.

Examples of the trivalent or higher carboxylic acid component include: 1,2,4-benzenetricarboxylic acid, 1,2,5-benzenetricarboxylic acid, 1,2,4-naphthalenetricarboxylic acid; and anhydrides thereof and lower alkyl esters thereof.

These may be used alone or in combination.

The acid component may also contain a dicarboxylic acid component having a sulfonic acid group, in addition to the polyvalent carboxylic acid component. The acid component may further contain a dicarboxylic acid component having a double bond.

Examples of the polyvalent alcohol component include bivalent alcohol components and trivalent or higher alcohol components.

The bivalent alcohol component is preferably an aliphatic diol, more preferably a straight-chain aliphatic diol in which the number of carbon atoms in the main chain part is 2 or more but 20 or less. When the straight-chain aliphatic diol is used, crystallinity of a polyester resin and the melting point are less decreased than the case where the branched aliphatic diol is used. The number of carbon atoms in the main chain part is more preferably 14 or less.

An amount of the aliphatic diol in the polyvalent alcohol component is preferably 80% by mole or more, more preferably 90% by mole or more. When the amount thereof is 80% by mole or more, crystallinity of the polyester resin is high, and the melting temperature is high. Therefore, the toner blocking resistance, the image storage stability, and the low-temperature fixability are more excellent.

Examples of the aliphatic diol include ethylene glycol, 1,3-propanediol, 1,4-butanediol, 1,5-pentanediol, 1,6-hexanediol, 1,7-heptanediol, 1,8-octanediol, 1-9-nonanediol, 1,10-decanediol, 1,11-undecanediol, 1,12-dodecanediol, 1,13-tridecanediol, 1,14-tetradecanediol, 1,18-octadecanediol and 1,14-eicosanedecanediol. Among them, ethylene glycol is preferable in terms of easy availability.

Examples of trivalent or higher alcohol include glycerin, trimethylolethane, trimethylolpropane, and pentaerythritol.

These may be used alone or in combination.

For the purpose of, for example, adjusting an acid value and a hydroxyl value according to the necessity, the polyvalent carboxylic acid or the polyvalent alcohol may be added at the final stage of the synthesis.

Examples of the polyvalent carboxylic acid include: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acid such as cyclohexanedicarboxylic acid.

Examples of the polyvalent alcohol include: aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as bisphenol A-ethylene oxide adduct and bisphenol A-propylene oxide adduct.

The crystalline polyester resin may be produced at a polymerization temperature of, for example, 180° C. or more but 230° C. or less. The reaction is promoted by reducing the pressure in the reaction system if necessary, and removing water or alcohol generated at the timer of condensation.

When a monomer is insoluble or incompatible at the reaction temperature, a solvent having a high boiling point may be added as a solubilizing agent in order to dissolve the monomer. The polycondensation reaction is promoted by removing the solubilizing agent. When a poorly compatible monomer exists in the copolymerization reaction, the poorly compatible monomer and an acid or alcohol to be polycondensed may be condensed in advance, and then the resultant may be subjected to polycondensation with the main component.

Examples of the catalyst that can be used for producing the polyester resin include; alkali metal compounds such as sodium and lithium; alkaline-earth metal compounds such as magnesium and calcium; metal compounds such as zinc, manganese, antimony, titanium, tin, zirconium, and germanium; phosphite compounds; phosphate compounds; and amine compounds.

Specific examples of the catalyst include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributylantimony, tin formate, tin oxalate, tetraphenyltin, dibutyltindichloride, dibutyltinoxide, diphenyltinoxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyltriphenylphosphoniumbromide, triethylamine, and triphenylamine.

The acid value of the crystalline polyester resin (the quantity of KOH in the mg unit necessary for neutralizing 1 g of the resin) is preferably in the range of 3.0 mg KOH/g or more but 30.0 mg KOH/g or less, more preferably in the range of 6.0 mg KOH/g or more but 25.0 mg KOH/g or less, still more preferably in the range of 8.0 mg KOH/g or more but 20.0 mg KOH/g or less.

A weight average molecular weight (Mw) of the crystalline polyester resin is preferably 6,000 or more but 35,000 or less. When the weight average molecular weight (Mw) is 6,000 or more, it is possible to prevent uneven fixing, which is caused by permeation of the toner into the surface of the recording medium such as paper when the toner is fixed thereon, and to prevent a decrease in the strength of folding resistance of the fixed image. When the weight average molecular weight (Mw) is 35,000 or less, the viscosity of the toner at the time of melting is not too high. As a result, a temperature at which the viscosity reaches the suitable level for fixing is not high, to thereby prevent the low-temperature fixability from being deteriorated.

A main component (50% by mass or more) of the crystalline resin containing the crystalline polyester resin is preferably a crystalline polyester resin synthesized by using an aliphatic monomer (hereinafter, may be referred to as "crystalline aliphatic polyester resin"). In this case, the composition ratio of an aliphatic monomer that constitutes the crystalline aliphatic polyester resin is preferably 60% by mole or more, more preferably 90% by mole or more. Suitable examples of the aliphatic monomer include the aliphatic diols and the dicarboxylic acids listed above.

An amount of the crystalline polyester resin is preferably 1% by mass or more but 20% by mass or less, more preferably 10% by mass or more but 18% by mass or less relative to an amount of the toner, in terms of the low-temperature fixability and the strength of the toner.

<Non-Crystalline Polyester Resin>

In the present disclosure, the toner preferably contains a non-crystalline polyester resin as a binder resin of the toner. Examples of the non-crystalline polyester resin include modified polyester resins and unmodified polyester resins. Inclusion of the modified polyester resin is more preferable.

<<Modified Polyester Resin>>

As the modified polyester resin, a modified polyester resin obtained by introducing a urea bond into a polyester resin can be use.

Examples of a constituent component of the modified polyester resin include a polyester prepolymer having an isocyanate group.

Examples of the polyester prepolymer (A) having an isocyanate group include a product obtained by reacting, with polyisocyanate (3), a polyester that is a polycondensate of polyol (1) and polycarboxylic acid (2) and has an active hydrogen group. Examples of the active hydrogen group contained in the polyester include hydroxyl groups (alcoholic hydroxyl groups and phenolic hydroxyl groups), amino groups, carboxyl groups, and mercapto groups. Among them, alcoholic hydroxyl groups are preferable.

Examples of the polyol (1) include diol (1-1) and trivalent or higher polyol (1-2). The (1-1) alone or a mixture of the (1-1) and a small amount of the (1-2) is preferable.

Examples of the diol (1-1) include alkylene glycols (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexanedimethanol and hydrogenated bisphenol A); bisphenols (e.g., bisphenol A, bisphenol F, and bisphenol S); alkylene oxide (e.g., ethylene oxide, propylene oxide, and butylene oxide) adducts of the above-listed alicyclic diols; and alkylene oxide (e.g., ethylene oxide, propylene oxide, and butylene oxide) adducts of the above-listed bisphenols. Among them, alkylene glycol having 2 or more but 12 or less carbon atoms and an alkylene oxide adduct of bisphenol are preferable. An alkylene oxide adduct of bisphenol, and a combination of alkylene oxide adduct of bisphenol and alkylene glycol having 2 or more but 12 or less carbon atoms are particularly preferable.

Examples of the trivalent or higher polyol (1-2) include trivalent or higher but octavalent or less aliphatic polyvalent alcohols; octavalent or higher aliphatic polyvalent alcohols (e.g., glycerin, trimethylolethane, trimethylolpropane, pentaerythritol, and sorbitol); trivalent or higher phenols (e.g., trisphenol PA, phenol novolac, and cresol novolac); and alkylene oxide adducts of the above trivalent or higher polyphenols.

Examples of the polycarboxylic acid (2) include dicarboxylic acid (2-1) and trivalent or higher polycarboxylic acid (2-2). The (2-1) alone and a mixture of the (2-1) and a small amount of the (2-2) are preferable.

Examples of the dicarboxylic acid (2-1) include alkylene dicarboxylic acids (e.g., succinic acid, adipic acid, and sebacic acid); alkenylene dicarboxylic acids (e.g., maleic acid and fumaric acid); and aromatic dicarboxylic acids (e.g., phthalic acid, isophthalic acid, terephthalic acid, and naphthalene dicarboxylic acid). Among them, alkenylenedicarboxylic acids having 4 or more but 20 or less carbon atoms and aromatic dicarboxylic acids having 8 or more but 20 or less carbon atoms are preferable.

Examples of the trivalent or higher polycarboxylic acid (2-2) include aromatic polycarboxylic acids having 9 or more but 20 or less carbon atoms (e.g., trimellitic acid and pyromellitic acid). As the polycarboxylic acid (2), acid anhydrides or lower alkyl esters (e.g., methyl ester, ethyl ester, and isopropyl ester) of the above may be used.

The ratio between the polyol (1) and the polycarboxylic acid (2) is typically from 2/1 through 1/1, preferably from 1.5/1 through 1/1, more preferably from 1.3/1 through 1.02/1, as the equivalent ratio [OH]/[COOH] of the hydroxyl group [OH] to the carboxyl group [COOH].

Examples of the polyisocyanate (3) include aliphatic polyisocyanates (e.g., tetramethylene diisocyanate, hexamethylene diisocyanate, and 2,6-diisocyanate methylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; polyisocyanates blocked with phenol derivative, oxime, caprolactam or the like; and combinations thereof.

The ratio of the polyisocyanate (3), as the equivalent ratio [NCO]/[OH] of an isocyanate group [NCO] to a hydroxyl group [OH] of the polyester having a hydroxyl group, is typically from 5/1 through 1/1, preferably from 4/1 through 1.2/1, more preferably from 2.5/1 through 1.5/1.

An amount of the polyisocyanate (3) constituent component in the polyester prepolymer (A) having an isocyanate group at an end thereof is typically 0.5% by mass or more but 40% by mass or less, preferably 1% by mass or more but 30% by mass or less, more preferably 2% by mass or more but 20% by mass or less.

The number of isocyanate groups contained per one molecule of the polyester prepolymer (A) having an isocyanate group is typically 1 or more, preferably from 1.5 or more but 3 or less on average, more preferably 1.8 or more but 2.5 or less on average.

In the present disclosure, amines may be used as a crosslinking agent and/or an elongating agent when the modified polyester resin is synthesized.

Examples of the amines (B) include diamine (B1), trivalent or higher polyamine (B2), amino alcohol (B3), amino mercaptan (B4), amino acid (B5), and a product (B6) obtained by blocking an amino group of any of B1 to B5.

Examples of the diamine (B1) include: aromatic diamines (e.g., phenylenediamine, diethyltoluene diamine, and 4,4'-diaminodiphenylmethane); alicyclic diamines (4,4'-diamino-3,3'-dimethyldicyclohexyl methane, diamine cyclohexane, and isophoronediamine); and aliphatic diamines (e.g., ethylenediamine, tetramethylenediamine, and hexamethylenediamine).

Examples of the trivalent or higher polyamine (B2) include diethylenetriamine and triethylenetetramine.

Examples of the amino alcohol (B3) include ethanolamine and hydroxyethyl aniline.

Examples of the amino mercaptan (B4) include aminoethylmercaptan and aminopropylmercaptan.

Examples of the amino acid (B5) include amino propionic acid and amino caproic acid.

Examples of the product (B6) obtained by blocking an amino group of any of B1 to B5 include ketimine compounds and oxazoline compounds obtained from any of the amines B1 to B5 and ketones (e.g., acetone, methyl ethyl ketone, and methyl isobutyl ketone). Among these amines (B), B1 and a mixture of B1 and a small amount of B2 are preferable.

In the crosslinking and/or elongation, a terminating agent can be used to adjust the molecular weight of the modified polyester resin obtained after the completion of the reaction according to the necessity. Examples of the terminating agent include monoamines (e.g., diethylamine, dibutylamine, butylamine, and laurylamine), and products obtained by blocking any of the monoamines (e.g., ketimine compounds).

The ratio of the amines (B), which is the equivalent ratio [NCO]/[NHx] of an isocyanate group [NCO] in the polyester prepolymer (A) having an isocyanate group to an amino group [NHx] in the amines (B), is typically from 1/2 through 2/1, preferably from 1.5/1 through 1/1.5, and more preferably from 1.2/1 through 1/1.2.

<<Unmodified Polyester Resin>>

In the present disclosure, instead of adding only the modified polyester resin (A), it is preferable to add an unmodified polyester (C) (unmodified polyester resin) as a toner binder component together with the (A). Use of the unmodified polyester (C) in combination improves low-temperature fixability, and also glossiness and uniformity of glossiness when the toner is used for a full-color apparatus. Examples of the (C) include a polycondensate of the same polyol (1) and polycarboxylic acid (2) exemplified above as the polyester components of the (A). Preferable examples thereof also include the same as the (A). The (C) may be not only a non-modified polyester, but also be one that is modified with a chemical bond other than a urea bond. For example, the (C) may be one modified with a urethane bond. It is preferable that the (A) and the (C) be at least partially compatible, in terms of the low-temperature fixability and the hot offset resistance. Therefore, it is preferable that the polyester component of the (A) and the (C) have similar compositions. When the (A) is contained, the mass ratio between (A) and (C) is typically from 5/95 through 75/25, preferably from 10/90 through 25/75, still more preferably from 12/88 through 25/75, and particularly preferably from 12/88 through 22/78.

A peak molecular weight of the (C) is typically 1,000 or more but 30,000 or less, preferably 1,500 or more but 10,000 or less, more preferably 2,000 or more but 8,000 or less. When the peak molecular weight thereof is 1,000 or more, the heat resistant storage stability is not deteriorated. When the peak molecular weight thereof is 10,000 or less, the low-temperature fixability is not deteriorated.

A hydroxyl value of the (C) is preferably 5 mg KOH/g or more, more preferably 10 mg KOH/g or more but 120 mg KOH/g or less, particularly preferably 20 mg KOH/g or more but 80 mg KOH/g or less. When the hydroxyl value thereof is 5 or more, it is advantageous in terms of the heat resistant storage stability and the low-temperature fixability.

An acid value of the (C) is typically 0.5 mg KOH/g or more but 40 mg KOH/g or less, preferably 5 mg KOH/g or more but 35 mg KOH/g or less. When the toner has an acid value, the toner easily tends to be negatively charged.

When the acid value and the hydroxyl value fall the aforementioned ranges respectively, the toner is less susceptible to influences from the environment under high-temperature and high-humidity conditions, and under low-temperature and low-humidity conditions, which does not result in deterioration of an image.

<Release Agent>

As the release agent, a common wax may be used.

The wax may be any conventional wax, and examples thereof include polyolefin waxes (e.g., polyethylene wax and polypropylene wax); long-chain hydrocarbons (e.g., paraffin wax and SASOL wax); and carbonyl group-containing waxes. Among them, paraffin wax is preferable.

Examples of the carbonyl group-containing wax include polyalkanoic acid esters (e.g., carnauba wax, montan wax, trimethylolpropane tribehenate, pentaerythritol tetrabehenate, pentaerythritol diacetate dibehenate, glycerin tribehenate, and 1,18-octadecanediol distearate); polyalkanol esters (e.g., tristearyl trimellitate and distearyl maleate); polyalkanoic acid amides (e.g., ethylenediamine dibehenylamide); polyalkylamides (e.g., trimellitic acid tristearylamide); and dialkyl ketones (e.g., distearyl ketone). Among them, polyalkanoic acid esters are preferable.

A melting point of the wax is generally 40° C. or more but 160° C. or less, preferably 50° C. or more but 120° C. or less, more preferably 60° C. or more but 90° C. or less.

A melt viscosity of the wax is preferably 5 cps or more but 1,000 cps or less, more preferably 10 cps or more but 100 cps or less, as a value measured at a temperature higher than the melting point by 20° C.

An amount of the wax in the toner is generally 0% by mass or more but 40% by mass or less, preferably 3% by mass or more but 30% by mass or less.

<Colorant>

The colorant is not particularly limited and any known dye and pigment may be used.

Examples of the dyes and pigments include, but are not limited to, carbon black, a nigrosine dye, iron black, naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), Vulcan fast yellow (5G, R), tartrazine lake, quinoline yellow lake, anthrasan yellow SGL, isoindolinon yellow, red iron oxide, red lead, lead vermilion, cadmium red, cadmium mercury red, antimony vermilion, permanent red 4R, parared, fiser red, p-chloro-o-nitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine, Prussian blue, anthraquinone blue, fast violet B, methyl violet lake, cobalt violet, manganese violet, dioxane violet, antraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and mixtures of the foregoing.

An amount of the colorant in the toner is generally 1% by mass or more but 15% by mass or less, preferably 3% by mass or more but 10% by mass or less.

The colorant can be used as masterbatch composited with a resin.

Examples of a binder resin that is kneaded with the masterbatch used in a method for producing the masterbatch include: polymers of styrene (e.g., polystyrene, poly-p-chlorostyrene, and polyvinyltoluene) and substituted products thereof, styrene-based compolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-malate copolymer; and polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, modified rosin, terpene resin, aliphatic or alicyclic hydrocarbon resin, aromatic petroleum resin, chlorinated paraffin, and paraffin wax, in addition to the modified polyester resins and the unmodified polyester resins exemplified above. These may be used alone or in combination.

The masterbatch of the present disclosure can be obtained by mixing a resin for masterbatch and a colorant by application of high shearing force and then kneading them. At this time, in order to improve interaction between the colorant and the resin, an organic solvent can be used. Such a method that an aqueous paste containing water of a colorant is mixed and kneaded with a resin and an organic solvent and the colorant is transferred to a side of the resin to thereby remove the water content and the organic solvent content (a so-called flushing method) is preferably used because a wet cake of the colorant can be directly used and is not required to be dried. In order to perform mixing and kneading, a highly shearing-dispersing apparatus such as a three-roll mill is preferably used.

<Charge Controlling Agent>

The toner of the present disclosure may contain a charge controlling agent according to the necessity.

The charge controlling agent may be a known charge controlling agent, and examples thereof include nigrosine dyes, triphenylmethane dyes, chromium-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives.

Specific examples of the charge controlling agent include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol-based condensate E-89 (available from Orient Chemical Industries Co., Ltd.); quaternary ammonium salt molybdenum complex TP-302 and TP-415 (available from Hodogaya Chemical Co., Ltd.); quaternary ammonium salt COPY CHARGE PSY VP2038, triphenylmethane derivative COPY BLUE PR, quaternary ammonium salt COPY CHARGE NEG VP2036, and COPY CHARGE NX VP434 (available from Hoechst GmbH); LRA-901 and boron complex LR-147 (available from Japan Carlit Co., Ltd.); copper phthalocyanine; perylene; quinacridone; azo-pigments; and polymeric compounds having, as a functional group, a sulfonic acid group, carboxyl group, quaternary ammonium salt, etc.

An amount of the charge controlling agent is not determined flatly, because it is determined depending on the type of the binder resin, presence or absence of an additive used according to necessity, and the toner producing method (including the dispersion method). However, an amount of the charge controlling agent is preferably 0.1 parts by mass or more but 10 parts by mass or less, more preferably 0.2 parts by mass or more but 5 parts by mass or less, relative to 100 parts by mass of the non-crystalline polyester resin.

These charge controlling agents may be dissolved and dispersed after being melted and kneaded together with the master batch and the resin. The charge controlling agents may be directly dissolved or dispersed in an organic solvent. Alternatively, the charge controlling agents may be fixed on surfaces of toner particles after production of the toner particles.

<External Additive>

As an external additive for assisting flowability, develop ability, and chargeability of the toner particles, oxide particles are preferable. However, in combination thereof, other inorganic fine particles and hydrophobized inorganic fine particles may be used.

It is more preferable to add at least one kind of inorganic fine particles of which hydrophobized primary particles have an average particle diameter of 1 nm or more but 100 nm or less, and more preferably 5 nm or more but 70 nm or less. It is more preferable to add at least one kind of inorganic fine particles of which hydrophobized primary particles have an average particle diameter of 20 nm or less, and to add at least one kind of inorganic fine particles of which hydrophobized primary particles have an average particle diameter of 30 nm or more. It is also preferable that the specific surface thereof measured by the BET method be 20 $m^2/g$ or more but 500 $m^2/g$ or less.

Examples of inorganic fine particles such as oxide fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are particularly preferable.

In addition to the above, it is also possible to use a metal salt of fatty acid (e.g., zinc stearate and aluminum stearate), fluoropolymer, and polymeric fine particles, for example, polystyrene, methacrylic acid ester copolymer, acrylic acid ester copolymer obtained by, soap-free emulsion polymerization, suspension polymerization, and dispersion polymerization, polymer particles obtained by polycondensation-based resins (e.g., silicone, benzoguanamine, and nylon) or thermosetting resins.

Particularly preferable examples of the external additive include hydrophobized silica, titania, titanium oxide, and alumina fine particles. Examples of silica fine particles include HDK H 2000, HDK H 2000/4, HDK H 2050EP, HVK21, and HDK H 1303 (available from Hoechst GmbH), and R972, R974, RX200, RY200, R202, R805, and R812 (available from Nippon Aerosil Co., Ltd.). Examples of titania fine particles include P-25 (available from Nippon Aerosil Co., Ltd.), STT-30 and STT-65C-S (available from Titan Kogyo Ltd.), TAF-140 (available from Fuji Titanium Industry, Co., Ltd.), and MT-150 W, MT-500B, MT-600B, and MT-150A (available from Tayca Corp.). Specific examples of the hydrophobized titanium oxide fine particles include: T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from Tayca Corp.); and IT-S (available from Ishihara Sangyo Kaisha Ltd.). Hydrophobized oxide fine particles, silica fine particles, titania fine particles, and alumina fine particles can be obtained by treating hydrophilic fine particles with a silane coupling agent such as methyltrimethoxysilane, methyltriethoxysilane, and octyltrimethoxysilane. Silicone oil-treated oxide fine particle, which are obtained by treating oxide fine particles with a silicone oil with heat being applied thereto if necessary, are also preferable.

Examples of the silicone oil include dimethylsilicone oil, methylphenylsilicone oil, chlorophenylsilicone oil, methylhydrogensilicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acryl, methacrylic-modified silicone oil, and α-methylstyrene-modified silicone oil.

An amount of the external additive is, for example, 0.1% by mass or more but 5% by mass or less, preferably 0.3% by mass or more but 3% by mass or less relative to an amount of the toner.

A glass transition temperature (Tg) of the toner of the present disclosure is typically, for example, 40° C. or more but 70° C. or less, preferably 45° C. or more but 55° C. or less. When the glass transition temperature (Tg) is 40° C. or more, the heat resistant storage stability of the toner becomes good. When the glass transition temperature (Tg) is 70° C. or less, the low-temperature fixability is more excellent.

For example, the toner of the present disclosure containing a cross-linked and/or elongated polyester resin exhibits better storage ability than known polyester-based toners even when the glass transition temperature is low.

As a storage elastic modulus of the toner of the present disclosure, a temperature (TG') at 10,000 dyne/cm$^2$ measured at a frequency of 20 Hz, is generally 100° C. or more, preferably 110° C. or more but 200° C. or less.

As the viscosity of the toner of the present disclosure, a temperature (Tη) at which the viscosity reaches 1,000 poise measured at a frequency of 20 Hz is generally 180° C. or less, preferably 90° C. or more but 160° C. or less. In order to achieve excellent low-temperature fixability and hot offset resistance, TG' is preferably higher than Tη. In other words, a difference (TG'−Tη) between TG' and Tη is preferably 0° C. or more. The difference is more preferably 10° C. or more, particularly preferably 20° C. or more. The upper limit of the difference is not particularly limited. The difference between Tη and Tg is preferably 0° C. or more but 100° C. or less in order to achieve heat resistant storage stability and excellent low-temperature fixability. The difference is more preferably 10° C. or more but 90° C. or less, particularly preferably 20° C. or more but 80° C. or less.

<Method for Controlling Domain Diameter of Crystalline Resin Encapsulated in Toner>

Figure 2:
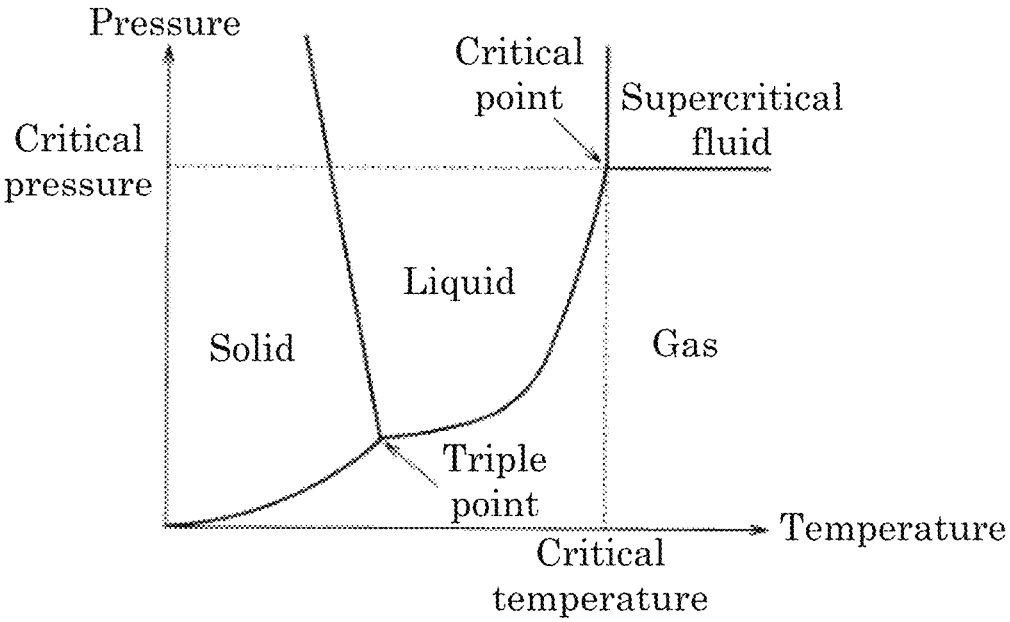
FIG. 2 is a phase diagram of $CO_2$.

The LCP is an abbreviation of Liquid Carbon Dioxide Process, and a process of dispersing a resin with a critical $CO_2$ as a solvent. FIG. 2 presents a phase diagram of $CO_2$. Being supercritical means a state where liquid and gas coexist when an environment is changed in temperature and pressure to be equal to or more than certain extents (critical points). In the case of carbon dioxide, the upper-right part in FIG. 2 corresponds to a supercritical state. The supercritical $CO_2$ having such characteristics has diffusibility like gas and solubility like liquid. Therefore, the supercritical $CO_2$ forms many resins into low molecules, resulting in good solubility. When decompression is performed at once with the supercritical $CO_2$ being permeated between resin molecules, $CO_2$ can be diffused at once to disperse the resin in pieces. At the time of decompression of the supercritical $CO_2$, all $CO_2$ as a solvent is changed to gas. Therefore, $CO_2$ can be immediately collected and recycled. This is a principle of the LCP dispersion. In the LCP-CPES (crystalline polyester resin) dispersion process, ethyl acetate is used as a solvent. First, CPES (crystalline polyester resin) and ethyl acetate are premixed. At this time, CPES is once completely dissolved in ethyl acetate. Then, the CPES-dissolved liquid is added to high-pressure $CO_2$, and pressure is applied thereto. Decompression promotes dispersion at once. This operation disperses CPES in coarse pieces, the coarse pieces are finally dispersed by a bead mill to be completed. In the CPES dispersion process with LCP, a median diameter of the CPES domain can be controlled by a CPES solution ER (Evaporated Residue) and a $CO_2$/CPES ratio. Additionally, the domain diameter of the crystalline resin can be decreased by decreasing the CPES solution ER or increasing the $CO_2$/CPES ratio.

<Annealing Treatment>

The annealing treatment enhances crystallinity of a crystalline resin. When a crystalline material is subjected to the annealing treatment, its heat increases the molecular mobility of a polymer chain to a certain extent. Therefore, the polymer chain is reoriented into a stabler structure; i.e., a regular crystal structure, resulting in crystallization. The annealing treatment activates molecular motion of the crystalline polyester in the toner as possible, and is performed within the limited temperature range relative to the melting point of the crystalline polyester. When the treatment is performed at a temperature equal to or higher than the melting point of the crystalline material, the polymer chain obtains energy that is higher than energy required for reorientation. Therefore, recrystallization does not occur. The annealing treatment may be performed in any stage so long as it is performed after a step of forming toner particles. Examples of another means for controlling crystallinity of a resin include a method for adjusting a difference between a solubility parameter of the non-crystalline polyester resin and a solubility parameter of the crystalline polyester resin. When a difference (SP1−SP2) between the SP value (SP1) of the non-crystalline polyester resin and the SP value (SP2) of the crystalline resin is more than 1.30, the non-crystalline polyester resin and the crystalline polyester resin are hardly compatible. Therefore, it is believed that functions of the respective resins are separated to keep the storage ability.

<Method for Confirming Domain of Crystalline Resin Encapsulated in Toner by Transmission Electron Microscope>

Confirmation of a domain of the crystalline resin encapsulated in the toner of the present disclosure is preferably evaluated by a method using TEM (transmission electron microscope) as described below.

A cross section of the toner observed by the transmission electron microscope (TEM) is prepared in the following manners. When the toner is stained with ruthenium, the crystalline resin contained in the toner has a large contrast, and is easily observed. When the ruthenium staining is used, the amount of the ruthenium atom varies depending on strength and weakness of the staining. Therefore, a portion strongly stained has a large number of these atoms and does not transmit electron rays, which is presented as a black image when observed. Meanwhile, a portion weakly stained easily transmits electron rays, which is presented as a white image when observed. More specifically, the crystalline polyester is more weakly stained than other organic components constituting the toner. It is believed that this is because penetration of the staining material into the crystalline polyester is weaker than penetration of the staining material into other organic components constituting the toner because of, for example, a difference of densities. The ruthenium that does not permeate into the inside of the crystalline polyester easily remains at an interface between the crystalline polyester and the non-crystalline resin. When the crystal has an acicular shape, the crystalline polyester is observed as a black image.

Hereinafter, a process of preparing a cross section of the toner stained with ruthenium will be described. First, the toner is immersed into a 0.5% by mass solution of ruthenium tetroxide, and is subjected to block staining for from 30 minutes through 90 minutes. Next, the toner stained with ruthenium is encapsulated in a resin obtained by mixing an epoxy resin as a main agent and amine as a curing agent at a mass ratio of 1:1, and the resultant is left to stand for 24 hours. Then, the encapsulated product is cut by a length of the radius of the toner from the outermost surface of the cylindrical resin (for example, 4.0 μm in the case where the weight average particle diameter (D4) is 8.0 μm) at a cutting rate of 0.6 mm/s using an ultrasonic ultramicrotome (available from Leica, UC7), to thereby expose the cross section of the central part of the toner. Then, it is cut so that the film thickness is 250 nm to prepare a thin piece sample of the cross section of the toner. By cutting the encapsulated product in this manner, the cross section of the central part of the toner can be obtained. The thin piece sample obtained is stained for 15 minutes under $RuO_4$ gas at an atmosphere of 500 Pa using a vacuum electron staining apparatus (available from filgen, VSC4R1H). Then, a scanning transmission electron microscope (available from JEOL, JEM2100) is used to prepare a TEM image. The TEM image obtained is used to observe the crystalline resin as a domain that is unevenly distributed on the cross section and the surface of the toner and is presented as black contrast using an image processing software "Image-J".

<Method for Measuring Domain Diameter of Crystalline Polyester Resin>

In the present disclosure, a domain diameter of the crystalline polyester resin means a number average of major diameters of domains of crystalline polyester resins determined based on the above TEM image.

Specifically, TEM images of cross sections of 100 toner particles are prepared by the aforementioned method. All the major diameters of the domains of the crystalline polyester resins existing in the cross sections of 100 toner particles are calculated using the image processing software "Image-J". Then, an arithmetic mean value thereof is calculated.

The obtained arithmetic mean value is regarded as the domain diameter of the crystalline polyester resin.

A domain diameter of the crystalline polyester resin is preferably 0.10 μm or more but 1.0 μm or less. The domain diameter of 0.10 μm or more is advantageous in terms of cleaning failure. The domain diameter of 1.0 μm or less is advantageous in terms of drawing ability.

<Evaluation of Amount of Crystalline Resin on Surface by TEM Image>

A small amount of the crystalline resin existing near the surface of the toner is more effective because cleaning failure is prevented. Examples of a means for preventing the crystalline resin from being exposed to the surface of the toner, and a means for finely dispersing the crystalline resin in the toner include addition of dispersant including a styrene-acryl-based skeleton as its structure and having affinity with the crystalline resin in the toner. When a coverage rate of the crystalline polyester resin on the surface of the toner is less than 20%, the crystalline resin is not too exposed to the surface of the toner particle. Therefore, adhesion force of the toner particle is increased, and prevention of cleaning failure can be highly achieved. As described above, the toner satisfying the range defined above can highly achieve prevention of cleaning failure. The coverage rate of the crystalline polyester resin on the surface of the toner can be determined by the above TEM image.

Specifically, TEM images of cross sections of 100 toner particles are prepared by the aforementioned method. Then, the image processing software "Image-J" is used to measure areas of all the crystalline polyester domains unevenly distributed in the toner surfaces (from the outermost surface to a depth of 10 mm) of 100 toner particles, and the areas of toner surfaces of 100 toner particles. Arithmetic mean values are substituted into the following Equation (1) to calculate the coverage rate (%).

$$\text{Coverage rate}(\%) = \frac{B}{A} \times 100 \qquad \text{Equation (1)}$$

Here, "A" is an arithmetic mean value of areas of toner surfaces when cross section is observed.

"B" is an arithmetic mean value of areas of crystalline polyester resin on the toner surfaces when the cross section is observed.

The coverage rate is preferably less than 10% because prevention of cleaning failure is more excellent.

The lower limit of the coverage rate is not particularly limited and may be appropriately selected depending on the intended purpose. For example, the lower limit of the coverage rate may be more than 0%, may be 3% or more, or may be 5% or more.

(Two-Component Carrier)

When the toner for electrostatic charge image development of the present disclosure is used in a two-component developer, it may be mixed with a magnetic carrier. A ratio between the carrier and the toner in the developer is preferably 1 part by mass or more but 10 parts by mass or less of the toner relative to 100 parts by mass of the carrier.

Examples of the magnetic carrier include those conventionally known in the art such as iron powder having a particle diameter of about 20 μm or more but 200 μm or less, ferrite powder having a particle diameter of about 20 μm or more but 200 μm or less, magnetite powder having a particle diameter of about 20 μm or more but 200 μm or less, and magnetic resin carrier having a particle diameter of about 20 μm or more but 200 μm or less. Examples of a coating material include: urea-formaldehyde resins, melamine resins; benzoguanamine resins; urea resins; polyamide resins; epoxy resins; acrylic resins; polymethyl methacrylate resins; polyacrylonitrile resins; polyvinyl acetate resins; polyvinyl alcohol resins; polyvinyl butyral resins; polystyrene-based resins such as polystyrene resins and styrene-acryl copolymer resins; halogenated olefin resins such as polyvinyl chloride; polyester-based resins such as polyethylene terephthalate resins and polybutylene terephthalate resins; polycarbonate-based resins; polyethylene resins; polyvinyl fluoride resins; polyvinylidene fluoride resins; polytrifluoroethylene resins; polyhexafluoropropylene resins; copolymers of vinylidene fluoride and an acryl monomer; copolymer of vinylidene fluoride and vinyl fluoride; fluoroterpolymers such as a terpolymer of tetrafluoroethylene, vinylidene fluoride, and a non-fluorinated monomer; and silicone resins. The coating resin may contain, for example, a conductive powder if necessary. Examples of the conductive powder include metal powder, carbon black, titanium oxide, tin oxide, and zinc oxide.

These conductive powders preferably have an average particle diameter of 1 μm or less. The toner for electrostatic charge image development of the present disclosure can be used as one-component magnetic toner without a carrier or as a non-magnetic toner.

(Toner Stored Unit)

A toner stored unit of the present disclosure includes: a unit configured to store a toner; and the toner for electrostatic charge image development stored in the unit. Examples of embodiments of the toner stored unit include a toner stored container, a developing device, and a process cartridge.

The toner stored container includes: a container; and the toner for electrostatic charge image development stored in the container.

The developing device is a device that has a unit configured to store the toner for electrostatic charge image development and develop the toner.

The process cartridge is a process cartridge in which at least an electrostatic latent image bearer (also referred to as an image bearer) and a developing unit are integrated. The process cartridge is configured to store the toner for electrostatic charge image development, and is detachably mounted in an image forming apparatus. The process cartridge may further include at least one selected from the group consisting of a charging unit, an exposing unit, and a cleaning unit.

When the toner stored unit of the present disclosure is mounted in an image forming apparatus to form an image, it is possible to perform image formation that utilizes characteristics of the toner for electrostatic charge image development including low drawing temperature, prevention of cleaning failure, low-temperature fixability, and high maximum fixing temperature.

(Image Forming Apparatus and Image Forming Method)

An image forming apparatus of the present disclosure includes at least an electrostatic latent image bearer, an electrostatic latent image forming unit, and a developing unit, and further includes other units if necessary.

An image forming method of the present disclosure includes at least an electrostatic latent image forming step and a developing step, and further includes other steps if necessary.

The image forming method can be suitably performed by the image forming apparatus. The electrostatic latent image forming step can be suitably performed by the electrostatic latent image forming unit. The developing step can be suitably performed by the developing unit. The other steps can be suitably performed by the other steps.

More preferably, an image forming apparatus of the present disclosure includes: an electrostatic latent image bearer; an electrostatic latent image forming unit configured to form an electrostatic latent image on the electrostatic latent image bearer; a developing unit including a toner and configured to develop, using the toner, the electrostatic latent image formed on the electrostatic latent image bearer, to form a toner image; a transfer unit configured to transfer the toner image formed on the electrostatic latent image bearer onto a surface of a recording medium; and a fixing unit configured to fix the toner image transferred onto the surface of the recording medium.

More preferably, the image forming method of the present disclosure includes: an electrostatic latent image forming step of forming an electrostatic latent image on an electrostatic latent image bearer; a developing step of developing, using a toner, the electrostatic latent image formed on the electrostatic latent image bearer, to form a toner image; a transfer step of transferring the toner image formed on the electrostatic latent image bearer onto a surface of a recording medium; and a fixing step of fixing the toner image transferred onto the surface of the recording medium.

In the developing unit and the developing step, the toner for electrostatic charge image development is used. The toner image may be formed by using a developer that preferably contains the toner for electrostatic charge image development, and further contains other components such as a carrier if necessary.

In the image forming apparatus and the image forming method, since the toner for electrostatic charge image development of the present disclosure is use, it is possible to perform image formation that utilizes characteristics of the toner for electrostatic charge image development including low drawing temperature, prevention of cleaning failure, low-temperature fixability, and high maximum fixing temperature.

<Electrostatic Latent Image Bearer>

A material, structure, and size of the electrostatic latent image bearer are not particularly limited and may be appropriately selected from those known in the art. Examples of the material include inorganic photoconductors (e.g., amorphous silicon and selenium) and organic photoconductors (e.g., polysilane and phthalopolymethine). Among them, amorphous silicon is preferable in terms of long life time.

<Electrostatic Latent Image Forming Unit and Electrostatic Latent Image Forming Step>

The electrostatic latent image forming unit is not particularly limited and may be appropriately selected depending on the intended purpose, so long as it is a unit configured to form an electrostatic latent image on the electrostatic latent image bearer. Examples of the electrostatic latent image forming unit include a unit that includes at least a charging member configured to charge a surface of the electrostatic latent image bearer and an exposing member configured to expose the surface of the electrostatic latent image bearer in an imagewise manner.

The electrostatic latent image forming step is not particularly limited and may be appropriately selected depending on the intended purpose, so long as it is a step of forming an electrostatic latent image on the electrostatic latent image bearer. For example, the electrostatic latent image forming step can be performed by using the electrostatic latent image forming unit, and can be performed by charging a surface of the electrostatic latent image bearer and exposing the surface in an imagewise manner.

<<Charging Member and Charging>>

The charging member is not particularly limited and may be appropriately selected depending on the intended purpose. Examples of the charging member include: contact chargers known in the art, equipped with, for example, a conductive or semiconductive roller, brush, film, or rubber blade; and non-contact chargers utilizing corona discharge, such as corotron and scorotron.

For example, the charging can be performed by applying voltage to the surface of the electrostatic latent image bearer using the charging member.

<<Exposing Member and Exposure>>

The exposing member is not particularly limited and may be appropriately selected depending on the intended purpose, so long as it can expose a surface of the electrostatic latent image bearer charged by the charging member in the shape of an image to be formed. Examples of the exposing member includes various exposing members, such as reproduction optical exposing members, rod-lens array exposing members, laser optical exposing members, and liquid crystal shutter optical exposing members.

<Developing Unit and Developing Step>

The developing unit is not particularly limited and may be appropriately selected depending on the intended purpose, so long as it is a developing unit including a toner and configured to develop the electrostatic latent image formed on the electrostatic latent image bearer, to form a visible image.

The developing step is not particularly limited and may be appropriately selected depending on the intended purpose, so long as it is a step of developing, using the toner, the electrostatic latent image formed on the electrostatic latent image bearer, to form a visible image. The developing step can be performed by, for example, the developing unit.

The developing unit may be a dry-development-type developing unit or may be a wet-development-type developing unit. Alternatively, the developing unit may be a developing unit for single color or may be a developing unit for multicolor. The developing unit is preferably a developing device that includes: a stirrer configured to rub and stir the toner to be charged; a magnetic field generating unit fixed inside the developing unit; and a rotatable developer bearer configured to bear a developer containing the toner on the surface.

<Other Units and Other Steps>

Examples of the other unit include a transfer unit, a fixing unit, a cleaning unit, a charge-eliminating unit, a recycling unit, and a controlling unit.

Examples of the other steps include a transfer step, a fixing step, a cleaning step, a charge-eliminating step, a recycling step, and a controlling step.

Image formation using the toner for electrostatic charge image development of the present disclosure will be described hereinafter.

Figure 3:
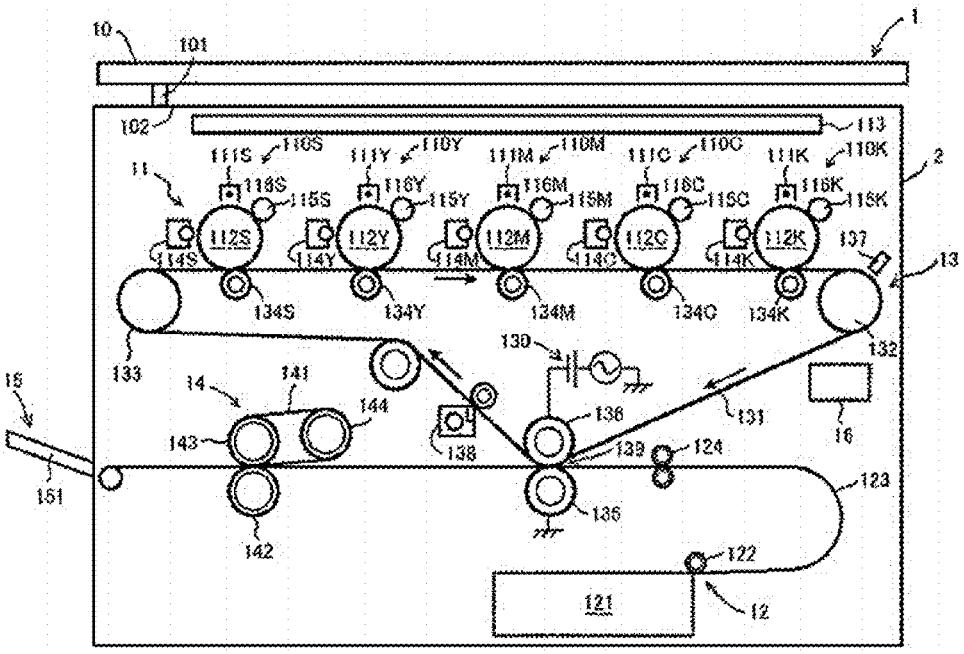
FIG. 3 is an entire configuration view of an image forming apparatus presenting one embodiment of the present disclosure.

FIG. 3 is an entire configuration view of an image forming apparatus presenting one embodiment of the present disclosure.

The image forming apparatus 1 presented in FIG. 3 is a color image forming apparatus configured to form a color image by a tandem-type image forming part (hereinafter referred to as an image forming part), including an image reading part 10, an image forming part 11, a paper sheet feeding part 12, a transfer part 13, a fixing part 14, and a paper ejection part 15.

The image reading part 10 is a part configured to read an image of a document and to generate image information. The image reading part 10 includes a contact glass 101 and a reading sensor 102. In the image reading part 10, light is emitted to the document, the reflected light is received by a sensor such as a charge coupled device (CCD) or a contact-type image sensor (CIS), and electrical color separation signals of RGB colors that are three primary colors of light are read.

The image forming part 11 includes five image forming units 110S, 110Y, 110M, 110C, and 110K configured to form and output toner images of four colors of yellow (Y), magenta (M), cyan (C), and black (K) and a toner (S) for electrostatic charge image development of the present disclosure.

The five image forming units 110S, 110Y, 110M, 110C, and 110K have the same configuration except that they use mutually different color toners of S toner, Y toner, M toner, C toner, and K toner as image forming materials. They are replaced at the end of their service life. Each of the image forming units 110S, 110Y, 110M, 110C, 110K is detachably mounted in an apparatus main body 2, constituting a so-called process cartridge. The common configuration will be described by taking, as an example, the image forming unit 110K configured to form a K toner image.

The image forming unit 110K includes, for example, a charging device 111K (charging member), a photoconductor 112K (electrostatic latent image bearer) as an image bearer for a K color toner configured to bear an image of the K color toner on a surface thereof, a developing device 114K (developing unit), a charge-eliminating device 115K, and a photoconductor cleaning device 116K (cleaning unit). Because these devices are held on the common holding body and are integratedly detachably mounted in the apparatus main body 2, they can be replaced at the same time.

The photoconductor 112K is a drum-shaped photoconductor with an outer diameter of 60 mm including an organic photoconductive layer formed on the surface of a substrate. The photoconductor 112K is driven by a driving unit to rotate counterclockwise. When the charging device 111K applies charging bias to a charging wire that is a charging electrode of a charger (a charging unit), discharge occurs between the charging wire and the circumferential surface of the photoconductor 112K to uniformly charge the surface of the photoconductor 112K. In the present embodiment, the surface of the photoconductor 112K is charged to have a negative polarity that is the same as the charging polarity of the toner. The charging bias employed is a charging bias generated by superimposing AC voltage on DC voltage. Instead of the charger, a charging roller disposed in contact with or in proximity to the photoconductor 112K may be used.

The uniformly charged surface of the photoconductor 112K is optically scanned with laser light emitted from an exposing device 113 (exposing member), which will be described below, to form an electrostatic latent image for K. In the entire region of the uniformly charged surface of the photoconductor 112K, the electrical potential is attenuated in the laser-irradiated portions to form an electrostatic latent image in which the electrical potential in the laser-irradiated portions is smaller than the electrical potential in the other portions (i.e., the background portion). The developing device 114K using the K toner, which will be described below, develops the electrostatic latent image for K to form a K toner image. The K toner image is primarily transferred onto an intermediate transfer belt 131, which will be described below.

The developing device 114K includes a container that stores a two-component developer including the K toner and a carrier, and is configured to bear the developer on the surface of a developing sleeve by the magnetic force of a magnet roller in the developing sleeve provided in the container. The developing sleeve receives a developing bias having the same polarity as the polarity of the toner and having such a charging electrical potential that is higher than the charging electrical potential of the electrostatic latent image on the photoconductor 112K but is lower than the charging electrical potential of the photoconductor 112K. Between the developing sleeve and the electrostatic latent image on the photoconductor 112K, a developing potential occurs from the developing sleeve toward the electrostatic latent image. Between the developing sleeve and the background portion of the photoconductor 112K, a non-developing potential occurs that transfers the toner on the developing sleeve toward the surface of the sleeve. By the action of the developing potential and the non-developing potential, the K toner on the developing sleeve is allowed to selectively adhere to the electrostatic latent image on the photoconductor 112K, followed by developing it, to form a toner image of the K color on the photoconductor 112K.

The charge-eliminating device 115K is configured to eliminate the charges from the surface of the photoconductor 112K after the toner image has been primarily transferred onto the intermediate transfer belt 131. The photoconductor cleaning device 116K includes a cleaning blade and a cleaning brush, and is configured to remove, for example, the residual toner remaining after transfer on the surface of the photoconductor 112K that has undergone charge-elimination by the charge-eliminating device 115K.

In FIG. 3, the image forming unit 110S includes, for example, a charging device 111S, a photoconductor 112S as an image bearer for a special color toner configured to bear an image of a special color toner on a surface thereof, a developing device 114S, a charge-eliminating device 115S, and a photoconductor cleaning device 116S. Each of the other image forming units 110C, 110M, and 110Y has the same configuration. That is, the image forming unit 110C, the image forming unit 110M, the image forming unit 110Y, and the image forming unit 110S form a S toner image, a Y toner image, a M toner image, and a C toner image on the photoconductor 112S, the photoconductor 112Y, the photoconductor 112M, and the photoconductor 112C, respectively, in the same manner as in the image forming unit 110K.

The exposing device 113 as a latent image writing member or an exposing member is disposed above the image forming units 110S, 110Y, 110M, 110C, and 110K. The exposing device 113 optically scans the photoconductors 112S, 112Y, 112M, 112C, and 112K with laser light emitted from a laser diode based on image information transmitted from the image reading part 10 or an external device such as a personal computer.

The exposing device 113 is configured to irradiate the photoconductors 112S, 112Y, 112M, 112C, and 112K with laser light emitted from a light source via a plurality of optical lenses and mirrors while a polygon mirror driven to rotate by a polygon motor polarizes the light in the main scanning direction. Instead of the laser light, LED light emitted from a plurality of LEDs may be employed for optical writing and irradiation.

The paper sheet feeding part 12 is configured to feed a paper sheet, which is one example of paper, to the transfer part 13, including a paper sheet housing 121, a paper sheet pickup roller 122, a paper sheet feeding belt 123, and a registration roller 124. The paper sheet pickup roller 122 is rotatably provided so as to transfer paper sheets stored in the paper sheet housing 121 toward the paper sheet feeding belt 123. The paper sheet pickup roller 122 as provided above is configured to pick up a paper sheet in the uppermost part from the stored paper sheets to place the paper sheet to the paper sheet feeding belt 123. The paper sheet feeding belt 123 is configured to convey the paper sheet picked up by the paper sheet pickup roller 122 to the transfer part 13. The registration roller 124 is configured to feed the paper sheet at the timing when a portion of the intermediate transfer belt 131 on which the toner image is formed reaches a secondary transfer nip 139 as a transfer nip of the transfer part 13.

The transfer part 13 is disposed under the image forming units 110S, 110Y, 110M, 110C, and 110K. The transfer part 13 includes a driving roller 132, a driven roller 133, an intermediate transfer belt 131, primary transfer rollers 134S, 134Y, 134M, 134C, and 134K, a secondary transfer roller 135, a secondary transfer counter roller 136, a toner deposition amount sensor 137, and a belt cleaning device 138.

The intermediate transfer belt 131 functions as an endless intermediate transfer member and is supported in a stretched manner by, for example, the driving roller 132, the driven roller 133, the secondary transfer counter roller 136, and the primary transfer rollers 134S, 134Y, 134M, 134C, and 134K arranged inside the loop of the intermediate transfer belt 131. Here, "being arranged" means "being disposed and provided" or "being provided at determined positions", and "being supported in a stretched manner" means "being supported under application of tension".

The driving roller 132 driven by the driving unit to rotate clockwise in FIG. 3 allows the intermediate transfer belt 131 to move and run endlessly in the same direction. The intermediate transfer belt 131 moves in the state of being in contact with the photoconductors 112S, 112Y, 112M, 112C, and 112K.

The thickness of the intermediate transfer belt 131 is from 20 through 200 [μm], preferably about 60 [μm]. A carbon dispersed polyimide resin having a volume resistivity of from $1\times10^{6}$ through $1\times10^{12}$ [Ω·cm], preferably about $1\times10^{6}$ [Ω·cm] (as measured at an applied voltage of 100 V using HIRESTA-UP MCP HT45 available from Mitsubishi Chemical Corporation) is desirable.

The toner deposition amount sensor 137 is disposed near the intermediate transfer belt 131 supported by the driving roller 132. The toner deposition amount sensor 137 functions as a toner amount detector configured to detect the amount of the toner image transferred onto the intermediate transfer belt 131. The toner deposition amount sensor 137 includes a light reflection-type photosensor. The toner deposition amount sensor 137 is configured to detect the quantity of light reflected from an image of the toner (including the special color toner) attached and formed on the intermediate transfer belt 131 to measure the toner deposition amount. Considering the functions, the toner deposition amount sensor 137 may be, for example, a toner density sensor conventionally used as a toner density detector configured to detect and measure the toner density. In this case, it is possible to avoid arranging a new toner amount detector, leading to cost reduction by virtue of the decreased number of parts. Instead of the position facing the intermediate transfer belt 131, the toner deposition amount sensor 137 may be disposed at such a position as to detect the toner image on the photoconductor 112.

Via the intermediate transfer belt 131, the primary transfer rollers 134S, 134Y, 134M, 134C, and 134K are disposed so as to face the photoconductors 112S, 112Y, 112M, 112C, and 112K, respectively. The primary transfer rollers 134S, 134Y, 134M, 134C, and 134K follow and rotate to move the intermediate transfer belt 131. With this configuration, a primary transfer nip is formed, at which the outside surface of the intermediate transfer belt 131 abuts on the photoconductors 112S, 112Y, 112M, 112C, and 112K (which means that the outside surface of the intermediate transfer belt 131 comes into contact with the photoconductors 112S, 112Y, 112M, 112C, and 112K). A primary transfer bias is applied to each of the primary transfer rollers 134S, 134Y, 134M, 134C, and 134K by a primary transfer bias power source. This forms primary transfer biases between S, Y, M, C, K toner images on the photoconductors 112S, 112Y, 112M, 112C, and 112K and the primary transfer rollers 134S, 134Y, 134M, 134C, and 134K. The toner images of respective colors are sequentially transferred onto the intermediate transfer belt 131.

The S toner image formed on the surface of the photoconductor 112S for S enters the primary transfer nip for S in response to the rotation of the photoconductor 112S. By the action of the transfer bias or the nip pressure, the S toner image is primarily transferred on the intermediate transfer belt 131 from the photoconductor 112S. The intermediate transfer belt 131 onto which the S toner image has been primarily transferred in this manner sequentially passes through the primary transfer nips for Y, M, C, and K. The Y, M, C, and K toner images on the photoconductors 112Y, 112M, 112C, and 112K are sequentially superimposed on the S toner image for primary transfer. Through the primary transfer by superimposing the toner images, a superimposed toner image including color toner images and a special toner (e.g., a clear toner) image is formed on the intermediate transfer belt 131. In other words, the toner images on the surfaces of the image bearers for color toners and the image bearer for the special toner are superimposed and transferred onto the intermediate transfer belt 131.

Each of the primary transfer rollers 134S, 134Y, 134M, 134C, and 134K is formed of an elastic roller that includes a metallic cored bar and an electrically conductive sponge layer fixed on the surface of the cored bar. Each primary transfer roller has an outer diameter of 16 [mm] and a cored bar diameter of 10 [mm]. The resistance value R of the sponge layer is calculated from the electric current I flowing when voltage of the 1,000 [V] is applied to the cored bars of the primary transfer rollers 134S, 134Y, 134M, 134C, and 134K with the grounded metallic roller having an outer diameter of 30 [mm] pressed against the sponge layer at a force of 10 [N]. Specifically, the resistance value R of the sponge layer, which is calculated based on the Ohm's low (R=V/I) from the electric current I flowing when voltage of the 1,000 [V] is applied to the cored bars, is about $3\times10^7$ [Ω]. The primary transfer bias output from the primary transfer bias power source under the constant current control is applied to the primary transfer rollers 134S, 134Y, 134M, 134C, and 134K. Instead of the primary transfer rollers 134S, 134Y, 134M, 134C, and 134K, for example, a transfer charger or a transfer brush may be used.

The secondary transfer roller 135 is driven to rotate by the driving unit with the intermediate transfer belt 131 and the paper sheet sandwiched between the secondary transfer roller 135 and the secondary transfer counter roller 136. The secondary transfer roller 135 contacts with the outside surface of the intermediate transfer belt 131 to form a secondary transfer nip 139 as a transfer nip. The secondary transfer roller 135 also functions as a nip forming member and a transfer member that transfer the toner image on the intermediate transfer belt to a recording medium sandwiched at the secondary transfer nip. The secondary transfer counter roller 136 functions as a nip forming member and a counter member. The secondary transfer roller 135 is grounded, while the secondary transfer counter roller 136 receives a secondary transfer bias applied by a secondary transfer bias power source 130.

The secondary transfer bias power source 130 includes a DC power source and an AC power source. The secondary transfer bias power source 130 can output the secondary transfer bias obtained by superimposing AC voltage on DC voltage. An output terminal of the secondary transfer bias power source 130 is coupled to a cored bar of the secondary transfer counter roller 136. An electrical potential of the cored bar of the secondary transfer counter roller 136 is substantially the same as the output voltage from the secondary transfer bias power source 130.

Application of the secondary transfer bias to the secondary transfer counter roller 136 forms, between the secondary transfer counter roller 136 and the secondary transfer roller 135, the secondary transfer bias that electrostatically transfers the toner having a negative polarity from a side of the secondary transfer counter roller 136 toward a side of the secondary transfer roller 135. This makes it possible to transfer the toner having a negative polarity on the intermediate transfer belt 131 from the side of the secondary transfer counter roller 136 toward the side of the secondary transfer roller 135.

The secondary transfer bias power source 130 uses a DC component having a negative polarity that is the same as the toner, so that the electrical potential of the superimposed bias averaged over time has a negative polarity that is the same as the toner. Instead of grounding the secondary transfer roller 135 while applying the superimposed bias to the secondary transfer counter roller 136, the cored bar of the secondary transfer counter roller 136 may be grounded while applying the superimposed bias to the secondary transfer roller 135. In this case, the DC voltage and the DC component are made different.

When using a paper sheet with a high degree of surface irregularities such as an embossed paper sheet, the superimposed bias is applied to reciprocally move the toner but relatively move the toner from the side of the intermediate transfer belt 131 toward the side of the paper sheet to transfer the toner onto the paper sheet. This makes it possible to improve transferability to concave portions of the paper, resulting in an increase in a transfer ratio and improvement in abnormal images such as voids. Meanwhile, when using a paper sheet with a low degree of surface irregularities such as a common transfer paper sheet, a contrast pattern reflecting the surface irregularities does not appear. Therefore, application of the secondary transfer bias generated only by the DC component makes it possible to obtain sufficient transferability.

The secondary transfer counter roller 136 includes a cored bar formed of, for example, stainless steel or aluminum, and a resistive layer laminated on the cored bar. The secondary transfer counter roller 136 has the following properties. Specifically, its outer diameter is about 24 [mm]. The diameter of the cored bar is about 16 [mm]. The resistive layer is formed of, for example, a material obtained by dispersing carbon or electrically conductive particles of, for example, metal complexes in polycarbonate, fluorine-based rubber, silicon-based rubber, rubber such as acrylonitrile-butadiene rubber (NBR) and ethylene-propylene-diene rubber (EPDM), rubber of NBR/epichlorohydrin rubber (ECO) copolymer, or semiconductive rubber formed of polyurethane. Its volume resistivity is from $10^6$ [Ω] through $10^{12}$ [Ω], desirably from $10^7$ [Ω] through $10^9$ [Ω]. A foamed rubber having a rubber hardness (ASKER-C) of from 20 degrees through 50 degrees, or a rubber having a rubber hardness of from 30 degrees through 60 degrees may be used. However, since the secondary transfer counter roller 136 contacts with the secondary transfer roller 135 via the intermediate transfer belt 131, it is desirably formed of a sponge that does not generate non-contact portions even under a small contact pressure. On the intermediate transfer belt 131 after the secondary transfer that has passed through the secondary transfer nip, there remains the toner that has not been transferred onto the paper sheet. This toner is removed and cleaned from the surface of the intermediate transfer belt 131 by a belt cleaning device 138 including a cleaning blade, which is in contact with the surface of the intermediate transfer belt 131.

The fixing part 14 is of a belt-fixing type, including an endless fixing belt 141 and a press roller 142 pressed against the fixing belt 141. The fixing belt 141 is supported around a fixing roller 143 and a heating roller 144, and at least one of the rollers is provided with a heat source/heating unit (e.g., heater, lamp, or electromagnetic induction-type heating device). The fixing belt 141 forms a fixing nip between the fixing belt 141 and the press roller 142 with the fixing belt 141 sandwiched and pressed between the fixing roller 143 and the press roller 142.

The paper sheet fed to the fixing part 14 is sandwiched at the fixing nip with the surface having an unfixed toner image adhering to the fixing belt 141. Because application of heat or pressure softens the toner in the toner image, the toner image is fixed, and then the paper sheet is ejected outside the apparatus. In the case where an image is formed on the other surface of the paper sheet opposite to the surface onto which the toner image has been transferred, the paper sheet is conveyed to a paper reversing mechanism after fixing of the toner image, and the paper sheet is reversed by the paper sheet reversing mechanism. The toner image is formed also on the opposite surface in the same manner as in the above-described image forming step.

The paper sheet on which the toner has been fixed in the fixing part 14 is ejected outside the apparatus from the image forming apparatus main body 2 via a paper ejection roller constituting the paper ejection part 15, and is housed in a paper sheet housing part 151 such as a paper sheet ejection tray.

EXAMPLES

Hereinafter, the present disclosure will be described by way of Examples. However, the present disclosure should not be construed as being limited to the Examples. In the Examples, "part(s)" and "%" mean "part(s) by mass" and "% by mass", respectively, unless otherwise specified. Various physical properties of toners of Examples and Comparative Examples measured by the aforementioned methods are summarized and presented in Table 1.

Example 1

<Preparation of Aqueous Phase>

Water (963 parts), a 48.3% aqueous solution of sodium dodecyl diphenyl ether disulfonate (ELEMINOL MON-7, obtained from Sanyo Chemical Industries, Ltd.) (37 parts), and ethyl acetate (90 parts) were mixed and stirred to obtain a milky white liquid, which was used as [Aqueous phase 1].

<Synthesis of Non-Crystalline Intermediate Polyester>

A reaction container equipped with a condenser, a stirrer, and a nitrogen introducing pipe was charged with bisphenol A-ethylene oxide 2 mol adduct (200 parts), bisphenol A-propylene oxide 2 mol adduct (563 parts), terephthalic acid (283 parts), trimellitic anhydride (22 parts), and dibutyltin oxide (2 parts). They were allowed to react at normal pressure at 230° C. for 7 hours, followed by further reaction at reduced pressure of from 10 mmHg through 15 mmHg for 5 hours, to obtain [Non-crystalline intermediate polyester 1].

Next, a reaction vessel equipped with a condenser, a stirrer, and a nitrogen introducing pipe was charged with the [Non-crystalline intermediate polyester 1] (410 parts), isophorone diisocyanate (89 parts), and ethyl acetate (500 parts), and they were allowed to react at 100° C. for 5 hours, to obtain [Prepolymer 1].

<Synthesis of Ketimine Compound>

Isophoronediamine (170 parts) and methyl ethyl ketone (75 parts) were charged into a reaction container equipped with a stirring bar and a thermometer, and were allowed to react at 45° C. for 5 hours and 30 minutes, to obtain [Ketimine compound 1].

<Synthesis of Crystalline Polyester Resin>

A reaction container equipped with a condenser, a thermometer, a stirrer, a dehydrator, and a nitrogen introducing tube was charged with stearic acid (248 parts), ethylene glycol (27 parts), and titanium dihydroxybis(triethanolaminate) (0.5 parts) as a condensation catalyst. They were allowed to react at 180° C. under nitrogen gas stream for 2 hours while generated water was removed, followed by further reaction for 3 hours under reduced pressure of from 5 mmHg through 20 mmHg, to obtain [Crystalline polyester resin 1].

<Preparation of Resin for Dispersing Crystalline Polyester Resin>

A 5 L-four neck flask equipped with a nitrogen introducing tube, a dehydration tube, a stirrer, and a thermocouple was charged with sebacic acid (6.0 parts), ethylene glycol (5.4 parts), fumaric acid (3.4 parts), and xylene (9.9 parts). The above materials were allowed to react at 180° C. for 10 hours. Then, the temperature was increased to 200° C. and the materials were allowed to react for 3 hours, followed by further reaction at a pressure of 8.3 KPa for 2 hours. A solution obtained by dissolving styrene (38.3 parts), methacrylic acid (0.3 parts), and di-t-butyl peroxide (1.2 parts) in xylene (3.9 parts) was added dropwise thereto for 3 hours. The resultant was maintained at 170° C. for 30 minutes, and the solvent was removed to obtain [Resin 1 for dispersing crystalline polyester resin].

<Preparation of Crystalline Polyester Resin Dispersion Liquid>

The [Crystalline polyester resin 1] (446 parts), ethyl acetate (1,894 parts), and the [Resin 1 for dispersing crystalline polyester resin] (446 parts) were charged into a pressure-resistant container in which stirring can be performed, followed by stirring using a device at 180 rpm for 4 hours. Carbon dioxide as a supercritical fluid was allowed to flow under the following conditions: 150° C.; 60 MPa; and a flow rate of 5.0 L/min (value in terms of the standard state) so that the volume ratio of carbon dioxide would be 85%, to prepare a mixture of the crystalline polyester resin and supercritical carbon dioxide. As a result, [Crystalline polyester resin dispersion liquid 1] was obtained.

<Preparation of Oil Phase>

A container equipped with a stirring bar and a thermometer was charged with paraffin wax (melting point: 90° C.) (120 parts), the [Crystalline polyester resin dispersion liquid 1] (446 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 1].

The [Material dissolved liquid 1] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 1].

<Emulsification and Solvent Removal>

The [Pigment/wax dispersion liquid 1] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 1].

A container equipped with a stirrer and a thermometer was charged with the [Emulsified slurry 1], and the solvent was removed at 30° C. for 8 hours. The resultant was left to stand at 30° C. for 10 hours to perform annealing, and was aged at 40° C. for 72 hours, to obtain [Dispersion Slurry 1].

<Washing and Drying>

The [Dispersion slurry 1] (100 parts) was filtrated under reduced pressure and was subjected to a series of washing treatment described below.

Specifically, ion-exchanged water (100 parts) was added to the obtained filtration cake and was mixed using a TK homomixer (at a number of revolutions of 12,000 rpm for 10 minutes), followed by filtration. Then, 10% hydrochloric acid (100 parts) was added to the obtained filtration cake and was mixed using a TK homomixer (at a number of revolutions of 12,000 rpm for 10 minutes), followed by filtration. Ion-exchanged water (300 parts) was added to the obtained filtration cake and was mixed using a TK homomixer (at a number of revolutions of 12,000 rpm for 10 minutes), followed by filtration. The aforementioned operations were performed twice to obtain [Filtration cake 1].

The [Filtration cake 1] was dried at 45° C. for 48 hours using a circulating dryer, and the resultant was sieved using a mesh having an opening of 75 μm to obtain [Toner base particles 1].

Next, silica having a large particle diameter (HSP160A obtained from FUSO CHEMICAL CO., LTD., RX40 obtained from NIPPON AEROSIL CO., LTD.) (2.20 parts) was added to the obtained toner base particles (100 parts), followed by mixing using a Henschel mixer. Moreover, silica having a small diameter (R972) (0.6 parts) was mixed using a Henschel mixer, and the coarse particles were removed using a screen having an opening of 37 μm, to prepare [Toner 1].

A domain diameter of the crystalline resin of the [Toner 1] was 0.60 μm, and a coverage rate of the crystalline resin on the surface of the toner was 8%.

Example 2

[Toner 2] was obtained in the same manner as in Example 1 except that the [Pigment/wax dispersion liquid 1] was changed to the following [Pigment/wax dispersion liquid 2].

A domain diameter of the crystalline resin of the [Toner 2] was 0.50 μm, and a coverage rate of the crystalline resin on the surface of the toner was 7%.

<Production of Non-Crystalline Resin A>

A 5 L-four neck flask equipped with a nitrogen introducing tube, a dehydration tube, a stirrer, and a thermocouple was charged with propylene glycol as diol, and dimethyl terephthalate and dimethyl adipate as dicarboxylic acids so that a molar ratio (dimethyl terephthalate/dimethyl adipate) between dimethyl terephthalate and dimethyl adipate would be 90/10 and a ratio (OH/COOH) between the OH group and the COOH group would be 1.2. The charged materials were allowed to react in the presence of 300 ppm of titanium tetraisopropoxide relative to the mass of the charged materials, while methanol was being allowed to outflow. The temperature was eventually increased to 230° C., and the resultant was allowed to react until an acid value of the resin reached 5 mg KOH/g or less. Then, it was allowed to react under reduced pressure of from 20 mmHg through 30 mmHg until the Mw reached 15,000. The reaction temperature was decreased to 180° C., and trimellitic anhydride was added thereto, to obtain [Non-crystalline resin A], which is a non-crystalline polyester resin in which carboxylic acid is imparted at an end thereof.

<Production of Crystalline Polyester Resin B>

A 5 L-four neck flask equipped with a nitrogen introducing tube, a dehydration tube, a stirrer, and a thermocouple was charged with 1,10-decanediol and decanedioic acid so that a ratio (OH/COOH) between the OH group and the COOH group would be 1.1. The charged materials were allowed to react with 300 ppm of titanium tetraisopropoxide relative to the mass of the charged materials, while water was being allowed to outflow. The temperature was eventually increased to 230° C., and the resultant was allowed to react until an acid value of the resin reached 5 mg KOH/g or less. Then, it was allowed to react under reduced pressure of 10 mmHg or less for 6 hours, to obtain [Crystalline polyester resin B].

<Preparation of Dispersant 1>

The [Non-crystalline resin A] (800 parts) and the [Crystalline polyester resin B] (200 parts) were mixed using a Henschel mixer (obtained from Mitsui Mining Co., Ltd.), and were kneaded using twin rolls at 100° C. for 10 minutes. After the resultant was rolled and cooled, it was pulverized by a pulverizer, to obtain [Dispersant 1].

<Preparation of Oil Phase>

A container equipped with a stirring bar and a thermometer was charged with paraffin wax (melting point: 90° C.) (120 parts), the [Crystalline polyester resin dispersion liquid 1] (335 parts), ethyl acetate (1,894 parts), and the [Dispersant 1] (6 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 2].

The [Material dissolved liquid 2] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 2].

Example 3

[Toner 3] was obtained as described below.

<Preparation of Crystalline Polyester Resin Dispersion Liquid>

The [Crystalline polyester resin 1] (446 parts), ethyl acetate (1,894 parts), and the [Resin 1 for dispersing crystalline polyester resin] (446 parts) were charged into a pressure-resistant container in which stirring can be performed, followed by stirring using a device at 180 rpm for 4 hours. Carbon dioxide as a supercritical fluid was allowed to flow under the following conditions: 150° C.; 60 MPa; and a flow rate of 5.0 L/min (value in terms of the standard state) so that the volume ratio of carbon dioxide would be 94%, to prepare a mixture of the crystalline polyester resin and supercritical carbon dioxide. As a result, [Crystalline polyester resin dispersion liquid 3] was obtained.

<Preparation of Oil Phase>

A container equipped with a stirring bar and a thermometer was charged with paraffin wax (melting point: 90° C.) (120 parts), the [Crystalline polyester resin dispersion liquid 3] (446 parts), ethyl acetate (1,894 parts), and the [Dispersant 1] (6 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 3].

The [Material dissolved liquid 3] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 3].

<Emulsification and Solvent Removal>

The [Pigment/wax dispersion liquid 3] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 3].

A container equipped with a stirrer and a thermometer was charged with the [Emulsified slurry 3], and the solvent was removed at 30° C. for 8 hours. The resultant was left to stand at 30° C. for 2 hours to perform annealing, and was aged at 40° C. for 72 hours, to obtain [Dispersion slurry 3].

<Washing and Drying>

The [Dispersion slurry 3] (100 parts) was filtrated under reduced pressure and was subjected to a series of washing treatment described below.

Specifically, ion-exchanged water (100 parts) was added to the obtained filtration cake and was mixed using a TK homomixer (at a number of revolutions of 12,000 rpm for 10 minutes), followed by filtration. Then, 10% hydrochloric acid (100 parts) was added to the obtained filtration cake and was mixed using a TK homomixer (at a number of revolutions of 12,000 rpm for 10 minutes), followed by filtration. Ion-exchanged water (300 parts) was added to the obtained filtration cake and was mixed using a TK homomixer (at a number of revolutions of 12,000 rpm for 10 minutes), followed by filtration. The aforementioned operations were performed twice to obtain [Filtration cake 3].

The [Filtration cake 3] was dried at 45° C. for 48 hours using a circulating dryer, and the resultant was sieved using a mesh having an opening of 75 μm to obtain [Toner base particles 3].

Next, silica having a large particle diameter (HSP160A obtained from FUSO CHEMICAL CO., LTD., RX40 obtained from NIPPON AEROSIL CO., LTD.) (2.20 parts) was added to the obtained toner base particles (100 parts), followed by mixing using a Henschel mixer. Moreover, silica having a small diameter (R972) (0.6 parts) was mixed using a Henschel mixer, and the coarse particles were removed using a screen having an opening of 37 μm, to prepare [Toner 3]. A domain diameter of the crystalline resin of the [Toner 3] was 0.10 μm, and a coverage rate of the crystalline resin on the surface of the toner was 12%.

Example 4

[Toner 4] was obtained in the same manner as in the <Washing and drying> of Example 1 except that the [Dispersion slurry 1] was changed to the following [Dispersion slurry 4].

A domain diameter of the crystalline resin of the [Toner 4] was 0.20 μm, and a coverage rate of the crystalline resin on the surface of the toner was 11%.

<Preparation of Oil Phase>

A container equipped with a stirring bar and a thermometer was charged with paraffin wax (melting point: 90° C.) (120 parts), the [Crystalline polyester resin dispersion liquid 3] (335 parts), ethyl acetate (1,894 parts), and the [Dispersant 1] (6 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 4].

The [Material dissolved liquid 4] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 4].

<Emulsification and Solvent Removal>

The [Pigment/wax dispersion liquid 4] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 4].

A container equipped with a stirrer and a thermometer was charged with the [Emulsified slurry 4], and the solvent was removed at 30° C. for 8 hours. The resultant was left to stand at 30° C. for 2 hours to perform annealing, and was aged at 40° C. for 72 hours, to obtain [Dispersion slurry 4].

Example 5

[Toner 5] was obtained in the same manner as in the <Washing and drying> of Example 1 except that the [Dispersion slurry 1] was changed to the following [Dispersion slurry 5].

A domain diameter of the crystalline resin of the [Toner 5] was 0.60 μm, and a coverage rate of the crystalline resin on the surface of the toner was 14%.

<Preparation of Crystalline Polyester Resin Dispersion Liquid>

The [Crystalline polyester resin 1] (446 parts) and ethyl acetate (1,894 parts) were charged into a pressure-resistant container in which stirring can be performed, followed by stirring using a device at 180 rpm for 4 hours. Carbon dioxide as a supercritical fluid was allowed to flow under the following conditions: 150° C.; 60 MPa; and a flow rate of 5.0 L/min (value in terms of the standard state) so that the volume ratio of carbon dioxide would be 85%, to prepare a mixture of the crystalline polyester resin and supercritical carbon dioxide. As a result, [Crystalline polyester resin dispersion liquid 5] was obtained.

<Preparation of Oil Phase>

A container equipped with a stirring bar and a thermometer was charged with paraffin wax (melting point: 90° C.) (120 parts), the [Crystalline polyester resin dispersion liquid 5] (446 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 5].

The [Material dissolved liquid 5] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 5].

<Emulsification and Solvent Removal>

The [Pigment/wax dispersion liquid 5] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 5].

A container equipped with a stirrer and a thermometer was charged with the [Emulsified slurry 5], and the solvent was removed at 30° C. for 8 hours. The resultant was left to stand at 30° C. for 10 hours to perform annealing, and was aged at 40° C. for 72 hours, to obtain [Dispersion slurry 5].

Example 6

[Toner 6] was obtained in the same manner as in the <Washing and drying> of Example 1 except that the [Dispersion slurry 1] was changed to the following [Dispersion slurry 6].

A domain diameter of the crystalline resin of the [Toner 6] was 0.50 μm, and a coverage rate of the crystalline resin on the surface of the toner was 13%.

<Preparation of Oil Phase>

A container equipped with a stirring bar and a thermometer was charged with paraffin wax (melting point: 90° C.) (120 parts), the [Crystalline polyester resin dispersion liquid 5] (335 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 6].

The [Material dissolved liquid 6] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 6].

<Emulsification and Solvent Removal>

The [Pigment/wax dispersion liquid 6] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 6].

A container equipped with a stirrer and a thermometer was charged with the [Emulsified slurry 6], and the solvent was removed at 30° C. for 8 hours. The resultant was left to stand at 30° C. for 10 hours to perform annealing, and was aged at 40° C. for 72 hours, to obtain [Dispersion slurry 6].

Example 7

[Toner 7] was obtained in the same manner as in the <Washing and drying> of Example 1 except that the [Dispersion slurry 1] was changed to the following [Dispersion slurry 7].

A domain diameter of the crystalline resin of the [Toner 7] was 0.60 μm, and a coverage rate of the crystalline resin on the surface of the toner was 14%.

<Preparation of Oil Phase>

A container equipped with a stirring bar and a thermometer was charged with paraffin wax (melting point: 90° C.) (120 parts), the [Crystalline polyester resin dispersion liquid 5] (112 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 7].

The [Material dissolved liquid 7] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 7].

<Emulsification and Solvent Removal>

The [Pigment/wax dispersion liquid 7] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 7].

A container equipped with a stirrer and a thermometer was charged with the [Emulsified slurry 7], and the solvent was removed at 30° C. for 8 hours. The resultant was left to stand at 30° C. for 10 hours to perform annealing, and was aged at 40° C. for 72 hours, to obtain [Dispersion slurry 7].

Example 8

[Toner 8] was obtained in the same manner as in the <Washing and drying> of Example 1 except that the [Dispersion slurry 1] was changed to the following [Dispersion slurry 8]. A domain diameter of the crystalline resin of the [Toner 8] was 0.10 μm, and a coverage rate of the crystalline resin on the surface of the toner was 13%.

<Preparation of Crystalline Polyester Resin Dispersion Liquid>

The [Crystalline polyester resin 1] (446 parts) and ethyl acetate (1,894 parts) were charged into a pressure-resistant container in which stirring can be performed, followed by stirring using a device at 180 rpm for 4 hours. Carbon dioxide as a supercritical fluid was allowed to flow under the following conditions: 150° C.; 60 MPa; and a flow rate of 5.0 L/min (value in terms of the standard state) so that the volume ratio of carbon dioxide would be 94%, to prepare a mixture of the crystalline polyester resin and supercritical carbon dioxide. As a result, [Crystalline polyester resin dispersion liquid 8] was obtained.

<Preparation of Oil Phase>

A container equipped with a stirring bar and a thermometer was charged with paraffin wax (melting point: 90° C.) (120 parts), the [Crystalline polyester resin dispersion liquid 8] (446 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 8].

The [Material dissolved liquid 1] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 8].

<Emulsification and Solvent Removal>

The [Pigment/wax dispersion liquid 8] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 8].

A container equipped with a stirrer and a thermometer was charged with the [Emulsified slurry 8], and the solvent was removed at 30° C. for 8 hours. The resultant was left to stand at 30° C. for 2 hours to perform annealing, and was aged at 40° C. for 72 hours, to obtain [Dispersion slurry 8].

Example 9

[Toner 9] was obtained in the same manner as in the <Washing and drying> of Example 1 except that the [Dispersion slurry 1] was changed to the following [Dispersion slurry 9].

A domain diameter of the crystalline resin of the [Toner 9] was 0.20 μm, and a coverage rate of the crystalline resin on the surface of the toner was 14%.

<Preparation of Oil Phase>

A container equipped with a stirring bar and a thermometer was charged with paraffin wax (melting point: 90° C.) (120 parts), the [Crystalline polyester resin dispersion liquid 8] (335 parts), and ethyl acetate (1,894 parts). Under stirring, the materials were warmed to 80° C., retained at 80° C. for 5 hours, and then cooled to 30° C. for 1 hour. Next, the container was charged with a cyan pigment (CI. Pigment blue 15:3) (250 parts) and ethyl acetate (1,000 parts), and the resultant was mixed for 1 hour, to obtain [Material dissolved liquid 9].

The [Material dissolved liquid 9] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 9].

<Emulsification and Solvent Removal>

The [Pigment/wax dispersion liquid 9] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 9].

A container equipped with a stirrer and a thermometer was charged with the [Emulsified slurry 9], and the solvent was removed at 30° C. for 8 hours. The resultant was left to stand at 30° C. for 2 hours to perform annealing, and was aged at 40° C. for 72 hours, to obtain [Dispersion slurry 9].

Example 10

[Toner 10] was obtained in the same manner as in the <Washing and drying> of Example 1 except that the [Dispersion slurry 1] was changed to the following [Dispersion slurry 10].

A domain diameter of the crystalline resin of the [Toner 10] was 1.10 μm, and a coverage rate of the crystalline resin on the surface of the toner was 25%.

<Preparation of Crystalline Polyester Resin Dispersion Liquid>

The [Crystalline polyester resin 1] (446 parts) and ethyl acetate (1,894 parts) were charged into a pressure-resistant container in which stirring can be performed, followed by stirring using a device at 180 rpm for 4 hours. Carbon dioxide as a supercritical fluid was allowed to flow under the following conditions: 150° C.; 60 MPa; and a flow rate of 5.0 L/min (value in terms of the standard state) so that the volume ratio of carbon dioxide would be 75%, to prepare a mixture of the crystalline polyester resin and supercritical carbon dioxide. As a result, [Crystalline polyester resin dispersion liquid 10] was obtained.

<Preparation of Oil Phase>

A container equipped with a stirring bar and a thermometer was charged with paraffin wax (melting point: 90° C.) (120 parts), the [Crystalline polyester resin dispersion liquid 10] (446 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 10].

The [Material dissolved liquid 10] (1,324 parts) was transferred to another container, and the pigment and the wax were dispersed using a beads mill (ULTRA VISCOMILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 10].

<Emulsification and Solvent Removal>

The [Pigment/wax dispersion liquid 10] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 10].

A container equipped with a stirrer and a thermometer was charged with the [Emulsified slurry 10], and the solvent was removed at 30° C. for 8 hours. The resultant was left to stand at 30° C. for 10 hours to perform annealing, and was aged at 40° C. for 72 hours, to obtain [Dispersion slurry 10].

Example 11

[Toner 11] was obtained in the same manner as in the <Washing and drying> of Example 1 except that the [Dispersion slurry 1] was changed to the following [Dispersion slurry 11].

A domain diameter of the crystalline resin of the [Toner 11] was 1.50 μm, and a coverage rate of the crystalline resin on the surface of the toner was 26%.

<Preparation of Crystalline Polyester Resin Dispersion Liquid>

The [Crystalline polyester resin 1] (446 parts) and ethyl acetate (1,894 parts) were charged into a pressure-resistant container in which stirring can be performed, followed by stirring using a device at 180 rpm for 4 hours. Carbon dioxide as a supercritical fluid was allowed to flow under the following conditions: 150° C.; 60 MPa; and a flow rate of 5.0 L/min (value in terms of the standard state) so that the volume ratio of carbon dioxide would be 73%, to prepare a mixture of the crystalline polyester resin and supercritical carbon dioxide. As a result, [Crystalline polyester resin dispersion liquid 11] was obtained.

<Preparation of Oil Phase>

A container equipped with a stirring bar and a thermometer was charged with paraffin wax (melting point: 90° C.) (120 parts), the [Crystalline polyester resin dispersion liquid 11] (446 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 11].

The [Material dissolved liquid 11] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 11].

<Emulsification and Solvent Removal>

The [Pigment/wax dispersion liquid 11] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 11].

A container equipped with a stirrer and a thermometer was charged with the [Emulsified slurry 11], and the solvent was removed at 30° C. for 8 hours. The resultant was left to stand at 30° C. for 10 hours to perform annealing, and was aged at 40° C. for 72 hours, to obtain [Dispersion slurry 11].

Example 12

[Toner 12] was obtained in the same manner as in the <Washing and drying> of Example 1 except that the [Dispersion slurry 1] was changed to the following [Dispersion slurry 12].

A domain diameter of the crystalline resin of the [Toner 12] was 0.08 μm, and a coverage rate of the crystalline resin on the surface of the toner was 10%.

<Preparation of Crystalline Polyester Resin Dispersion Liquid>

The [Crystalline polyester resin 1] (401 parts) and ethyl acetate (1,894 parts) were charged into a pressure-resistant container in which stirring can be performed, followed by stirring using a device at 180 rpm for 4 hours. Carbon dioxide as a supercritical fluid was allowed to flow under the following conditions: 150° C.; 60 MPa; and a flow rate of 5.0 L/min (value in terms of the standard state) so that the volume ratio of carbon dioxide would be 73%, to prepare a mixture of the crystalline polyester resin and supercritical carbon dioxide. As a result, [Crystalline polyester resin dispersion liquid 12] was obtained.

<Preparation of Oil Phase>

A container equipped with a stirring bar and a thermometer was charged with paraffin wax (melting point: 90° C.) (120 parts), the [Crystalline polyester resin dispersion liquid 12] (446 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 12].

The [Material dissolved liquid 12] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 12].

<Emulsification and Solvent Removal>

The [Pigment/wax dispersion liquid 12] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 12].

A container equipped with a stirrer and a thermometer was charged with the [Emulsified slurry 12], and the solvent was removed at 30° C. for 8 hours. The resultant was left to stand at 30° C. for 10 hours to perform annealing, and was aged at 40° C. for 72 hours, to obtain [Dispersion slurry 12].

Comparative Example 1

[Toner 13] was obtained in the same manner as in the <Washing and drying> of Example 1 except that the [Dispersion slurry 1] was changed to the following [Dispersion slurry 13].

A domain diameter of the crystalline resin of the [Toner 13] was 1.90 μm, and a coverage rate of the crystalline resin on the surface of the toner was 14%.

<Preparation of Oil Phase>

A container equipped with a stirring bar and a thermometer was charged with paraffin wax (melting point: 90° C.) (120 parts), the [Crystalline polyester resin 1] (669 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 13].

The [Material dissolved liquid 13] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 13].

<Emulsification and Solvent Removal>

The [Pigment/wax dispersion liquid 13] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 13].

A container equipped with a stirrer and a thermometer was charged with the [Emulsified slurry 13], and the solvent was removed at 30° C. for 8 hours. The resultant was aged at 40° C. for 72 hours, to obtain [Dispersion slurry 13].

Comparative Example 2

[Toner 14] was obtained in the same manner as in the <Washing and drying> of Example 1 except that the [Dispersion slurry 1] was changed to the following [Dispersion slurry 14].

A domain diameter of the crystalline resin of the [Toner 14] was 2.1 μm, and a coverage rate of the crystalline resin on the surface of the toner was 13%.

<Preparation of Oil Phase>

A container equipped with a stirring bar and a thermometer was charged with paraffin wax (melting point: 90° C.) (120 parts), the [Crystalline polyester resin 1] (446 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 14].

The [Material dissolved liquid 14] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 14].

<Emulsification and Solvent Removal>

The [Pigment/wax dispersion liquid 14] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 14].

A container equipped with a stirrer and a thermometer was charged with the [Emulsified slurry 14], and the solvent was removed at 30° C. for 8 hours. The resultant was left to stand at 30° C. for 1 hour to perform annealing, and was aged at 40° C. for 72 hours, to obtain [Dispersion slurry 14].

Comparative Example 3

[Toner 15] was obtained in the same manner as in the <Washing and drying> of Example 1 except that the [Dispersion slurry 1] was changed to the following [Dispersion slurry 15].

A domain diameter of the crystalline resin of the [Toner 15] was 0.90 μm, and a coverage rate of the crystalline resin on the surface of the toner was 35%.

<Emulsification and Solvent Removal>

The [Pigment/wax dispersion liquid 14] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 15].

A container equipped with a stirrer and a thermometer was charged with the [Emulsified slurry 15], and the solvent was removed at 30° C. for 8 hours. The resultant was aged at 40° C. for 72 hours, to obtain [Dispersion slurry 15].

Comparative Example 4

[Toner 16] was obtained in the same manner as in the <Washing and drying> of Example 1 except that the [Dispersion slurry 1] was changed to the following [Dispersion slurry 16].

A domain diameter of the crystalline resin of the [Toner 16] was 2.00 μm, and a coverage rate of the crystalline resin on the surface of the toner was 36%.

<Preparation of Oil Phase>

A container equipped with a stirring bar and a thermometer was charged with paraffin wax (melting point: 90° C.) (120 parts), the [Crystalline polyester resin 1] (491 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 16].

The [Material dissolved liquid 16] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 16].

<Emulsification and Solvent Removal>

The [Pigment/wax dispersion liquid 16] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 16].

A container equipped with a stirrer and a thermometer was charged with the [Emulsified slurry 16], and the solvent was removed at 30° C. for 8 hours. The resultant was left to stand at 30° C. for 10 hours to perform annealing, and was aged at 40° C. for 72 hours, to obtain [Dispersion slurry 16].

Comparative Example 5

[Toner 17] was obtained in the same manner as in the <Emulsification and solvent removal> and the <Washing and drying> of Example 1 except that the [Pigment/wax dispersion liquid 1] was changed to the following [Pigment/wax dispersion liquid 17].

A domain diameter of the crystalline resin of the [Toner 17] was 0.60 μm, and a coverage rate of the crystalline resin on the surface of the toner was 8%.

<Preparation of Oil Phase>

A container equipped with a stirring bar and a thermometer was charged with paraffin wax (melting point: 90° C.) (120 parts), the [Crystalline polyester resin 1] (112 parts), ethyl acetate (1,894 parts), and the [Dispersant 1] (6 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 17].

The [Material dissolved liquid 17] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 17].

Comparative Example 6

[Toner 18] was obtained in the same manner as in the <Washing and drying> of Example 1 except that the [Dispersion slurry 1] was changed to the following [Dispersion slurry 18].

A domain diameter of the crystalline resin of the [Toner 18] was 0.10 μm, and a coverage rate of the crystalline resin on the surface of the toner was 12%.

<Preparation of Oil Phase>

A container equipped with a stirring bar and a thermometer was charged with paraffin wax (melting point: 90° C.) (120 parts), the [Crystalline polyester resin 1] (178 parts), ethyl acetate (1,894 parts), and the [Dispersant 1] (6 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 18].

The [Material dissolved liquid 18] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 18].

<Emulsification and Solvent Removal>

The [Pigment/wax dispersion liquid 18] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 18].

A container equipped with a stirrer and a thermometer was charged with the [Emulsified slurry 18], and the solvent was removed at 30° C. for 8 hours. The resultant was left to stand at 30° C. for 2 hours to perform annealing, and was aged at 40° C. for 72 hours, to obtain [Dispersion slurry 18].

Comparative Example 7

[Toner 19] was obtained in the same manner as in the <Washing and drying> of Example 1 except that the [Dispersion slurry 1] was changed to the following [Dispersion slurry 19].

A domain diameter of the crystalline resin of the [Toner 19] was 2.10 μm, and a coverage rate of the crystalline resin on the surface of the toner was 37%.

<Preparation of Oil Phase>

A container equipped with a stirring bar and a thermometer was charged with paraffin wax (melting point: 90° C.) (120 parts), the [Crystalline polyester resin dispersion liquid 1] (669 parts), and ethyl acetate (1,894 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 19].

The [Material dissolved liquid 19] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 19].

<Emulsification and Solvent Removal>

The [Pigment/wax dispersion liquid 19] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 19].

A container equipped with a stirrer and a thermometer was charged with the [Emulsified slurry 19], and the solvent was removed at 30° C. for 8 hours. The resultant was left to stand at 30° C. for 10 hours to perform annealing, and was aged at 40° C. for 72 hours, to obtain [Dispersion slurry 19].

Comparative Example 8

[Toner 20] was obtained in the same manner as in the <Washing and drying> of Example 1 except that the [Dispersion slurry 1] was changed to the following [Dispersion slurry 20].

A domain diameter of the crystalline resin of the [Toner 20] was 0.65 μm, and a coverage rate of the crystalline resin on the surface of the toner was 7%.

<Preparation of Crystalline Polyester Resin Dispersion Liquid>

The [Crystalline polyester resin 1] (446 parts), ethyl acetate (1,894 parts), and the [Resin 1 for dispersing crystalline polyester resin] (446 parts) were charged into a pressure-resistant container in which stirring can be performed, followed by stirring using a device at 180 rpm for 4 hours. Carbon dioxide as a supercritical fluid was allowed to flow under the following conditions: 150° C.; 60 MPa; and a flow rate of 5.0 L/min (value in terms of the standard state) so that the volume ratio of carbon dioxide would be 85%, to prepare a mixture of the crystalline polyester resin and supercritical carbon dioxide. As a result, [Crystalline polyester resin dispersion liquid 20] was obtained.

<Preparation of Oil Phase>

A container equipped with a stirring bar and a thermometer was charged with paraffin wax (melting point: 90° C.) (120 parts), the [Crystalline polyester resin dispersion liquid 20] (335 parts), ethyl acetate (1,894 parts), and the [Dispersant 1] (6 parts). Under stirring, the materials were warmed to 80° C., retained at 80° C. for 5 hours, and then cooled to 30° C. for 1 hour. Next, the container was charged with a cyan pigment (C.I. Pigment blue 15:3) (250 parts) and ethyl acetate (1,000 parts), and the resultant was mixed for 1 hour, to obtain [Material dissolved liquid 20].

The [Material dissolved liquid 20] (1,324 parts) was transferred to another container, and the pigment and the wax were dispersed using a beads mill (ULTRA VISCO-MILL, obtained from Imex Co., Ltd.) at a liquid delivering speed of 1 kg/hr, at a disk peripheral velocity of 6 m/second, with 0.5 mm-zirconia beads packed to 80% by volume, and for 5 passes, to obtain [Pigment/wax dispersion liquid 20].

<Emulsification and Solvent Removal>

The [Pigment/wax dispersion liquid 20] (375 parts), the [Prepolymer 1] (500 parts), and the [Ketimine compound 1] (15 parts) were charged into a container, and mixed using a TK homomixer (obtained from Tokushu Kika Kogyo Co., Ltd.) for 5 minutes at 5,000 rpm. Then, the [Aqueous phase 1] (1,200 parts) was added to the container, followed by mixing using a TK homomixer at a number of revolutions of 10,000 rpm for 1.5 hours, to obtain [Emulsified slurry 20].

A container equipped with a stirrer and a thermometer was charged with the [Emulsified slurry 20], and the solvent was removed at 30° C. for 8 hours. The resultant was left to stand at 30° C. for 12 hours to perform annealing, and was aged at 40° C. for 72 hours, to obtain [Dispersion slurry 20].

(Production of Carrier)

The following coating materials were dispersed using a stirrer for 10 minutes to prepare a coating liquid. The coating liquid (920 parts) and a core material (Mn ferrite particles, weight average diameter: 35 μm) (5,000 parts) were charged into a coating apparatus to coat the coating liquid on the core material. Here, the coating apparatus includes a rotational bottom plate disk and an impeller in a fluidized bed and is configured to perform coating while rotational flow is generated. The coated product obtained was baked at 250° C. for 2 hours in an electric furnace, to obtain a ferrite carrier having an average particle diameter of 35 μm and being coated with silicone resin (an average thickness of 0.5 μm).

| <Coating materials> | |
|---|---|
| Toluene | 450 parts |
| Silicone resin SR2400 | 450 parts (obtained from DuPont Toray Specialty Materials K.K., non-volatile component: 50%) |
| Aminosilane SH6020 (obtained from DuPont Toray Specialty Materials K.K.) | 10 parts |
| Carbon black | 10 parts |

(Preparation of Two-Component Developer)

The prepared carrier (100 parts) and each toner (7 parts) of Examples and Comparative Examples were homogeneously mixed using a TURBULA mixer configured to roll and invert its container for stirring, to be electrically charged. As a result, a two-component developer was prepared.

<Evaluation Method>

The prepared toners for evaluation of Examples 1 to 12 and Comparative Examples 1 to 8 were used to evaluate items of (1) cold offset temperature, (2) hot offset temperature, (3) minimum scratch temperature, and (4) cleaning failure in the following manners. Results are presented in the following Table 2.

<Evaluation Items>

(1) Cold Offset Temperature

The toner (5 parts) and silicone coating carrier (95 parts) having a weight average particle diameter of 60 μm were homogeneously mixed to prepare a two-component developer for evaluation. An unfixed image, which was developed by the developer using a commercially available copying machine (imagio NEO450: obtained from Ricoh Company, Ltd.), was fixed at a process speed of 230 mm/sec using the commercially available copying machine (imagio NEO450: obtained from Ricoh Company, Ltd.) in which a fixing unit had been modified and the temperature of a thermal roller was variable.

An image after fixing was visually observed, and a fixing roller temperature at which cold offset did not occur was defined as the minimum fixing temperature.

[Evaluation Criteria of Cold Offset Resistance]

A: The minimum fixing temperature was 130° C. or less.

B: The minimum fixing temperature was more than 130° C. but 135° C. or less.

C: The minimum fixing temperature was more than 135° C. but 140° C. or less.

D: The minimum fixing temperature was more than 140° C.

(2) Hot Offset Temperature

Evaluation of fixing was performed in the same manner as in the above minimum fixing temperature. Whether hot offset occurred on a fixed image was visually evaluated.

A fixing roller temperature at which hot offset occurred was defined as the hot offset temperature.

[Evaluation Criteria of Hot Offset Resistance]

A: The maximum fixing temperature was 200° C. or more.

B: The maximum fixing temperature was 195° C. or more but less than 200° C.

C: The maximum fixing temperature was 190° C. or more but less than 195° C.

D: The maximum fixing temperature was less than 190° C.

(3) Minimum Scratch Temperature

A HEIDON scratch sapphire needle was set in a scratch tester. A radius of a circle scratched by the needle was set to 8 mm, and the load was set to 50 g.

An image on paper that had passed through the fixing device was immobilized on a plate of the scratch tester, and a handle was turned about ten times. The number of revolutions of the handle was from about 1 time/sec through about 2 time/sec. The scratched sample was strongly rubbed using HONECOTTO #440 or its counterpart 5 times back and forth.

At this time, a temperature at which no exfoliation occurred was defined as the minimum scratch temperature.

[Evaluation Criteria]

A: The minimum scratch temperature was 100° C. or less.

B: The minimum scratch temperature was 100° C. or more but less than 105° C.

C: The minimum scratch temperature was 105° C. or more but less than 110° C.

D: The minimum scratch temperature was 110° C. or more.

(4) Cleaning Failure

The developer (prepared two-component developer) was used to perform printing on 10 K (1K=1000) sheets of paper with an existing Ricoh copying machine. Then, the developer was exposed to an environment (a temperature of 10° C. and a humidity of 15% RH). Under this condition, printing was performed on 1 K sheets of paper.

Then, when one sheet of white paper image was fed, a photoconductor was stopped immediately after the white pater image passed a cleaning blade. After the photoconductor passed through the cleaning blade, the remaining toner on the photoconductor was transferred onto a piece of tape. Then, a difference between the image density of the untransferred tape and the image density of the transferred tape was measured and judged using a spectrodensitometer (obtained from X-Rite).

[Evaluation Criteria]

A: The difference between the image density of the untransferred tape and the image density of the transferred tape was less than 0.01.

B: The difference between the image density of the untransferred tape and the image density of the transferred tape was 0.01 or more but less than 0.05.

C: The difference between the image density of the untransferred tape and the image density of the transferred tape was 0.05 or more but less than 0.11.

D: The difference between the image density of the untransferred tape and the image density of the transferred tape was 0.11 or more.

TABLE 1

| | | Relaxation time | | Formulation | Mixing conditions | | Annealing conditions | | Toner physical properties | |
|---|---|---|---|---|---|---|---|---|---|---|
| | Toner | T2 at 50° C. (ms) | T2 at 90° C. (ms) | Amount of crystalline resin (parts) | Dispersant (parts) | $CO_2$/ dispersion liquid (%) | Temperature (° C.) | Time (h) | Domain diameter of crystalline resin (μm) | Coverage rate of crystalline resin on surface (%) |
| Ex. 1 | 1 | 0.0190 | 1.45 | 20 | 0 | 85 | 30 | 10 | 0.60 | 8 |
| Ex. 2 | 2 | 0.0190 | 0.85 | 15 | 6 | 85 | 30 | 10 | 0.50 | 7 |
| Ex. 3 | 3 | 0.0280 | 1.45 | 20 | 6 | 94 | 30 | 2 | 0.10 | 12 |
| Ex. 4 | 4 | 0.0280 | 0.85 | 15 | 6 | 94 | 30 | 2 | 0.20 | 11 |
| Ex. 5 | 5 | 0.0280 | 1.45 | 20 | 0 | 85 | 30 | 10 | 0.60 | 14 |
| Ex. 6 | 6 | 0.0280 | 0.85 | 15 | 0 | 85 | 30 | 10 | 0.50 | 13 |
| Ex. 7 | 7 | 0.0280 | 0.35 | 5 | 0 | 85 | 30 | 10 | 0.60 | 14 |
| Ex. 8 | 8 | 0.0190 | 1.45 | 20 | 0 | 94 | 30 | 2 | 0.10 | 13 |
| Ex. 9 | 9 | 0.0190 | 0.85 | 15 | 0 | 94 | 30 | 2 | 0.20 | 14 |
| Ex. 10 | 10 | 0.0220 | 1.46 | 20 | 0 | 75 | 30 | 10 | 1.10 | 25 |
| Ex. 11 | 11 | 0.0230 | 1.47 | 20 | 0 | 73 | 30 | 10 | 1.50 | 26 |
| Ex. 12 | 12 | 0.0250 | 0.90 | 18 | 0 | 73 | 30 | 10 | 0.08 | 10 |
| Comp. Ex. 1 | 13 | 0.0240 | 1.70 | 30 | 0 | None | None | None | 1.90 | 14 |
| Comp. Ex. 2 | 14 | 0.0230 | 0.20 | 20 | 0 | None | 30 | 1 | 2.10 | 13 |
| Comp. Ex. 3 | 15 | 0.8500 | 0.91 | 20 | 0 | None | None | None | 0.90 | 35 |
| Comp. Ex. 4 | 16 | 0.0150 | 0.89 | 22 | 0 | None | 30 | 10 | 2.00 | 36 |
| Comp. Ex. 5 | 17 | 0.0190 | 0.25 | 5 | 6 | None | 30 | 10 | 0.60 | 8 |
| Comp. Ex. 6 | 18 | 0.0280 | 0.25 | 8 | 6 | None | 30 | 2 | 0.10 | 12 |
| Comp. Ex. 7 | 19 | 0.0350 | 0.90 | 30 | 0 | 85 | 30 | 10 | 2.10 | 37 |
| Comp. Ex. 8 | 20 | 0.0180 | 0.90 | 5 | 6 | 85 | 30 | 12 | 0.65 | 7 |

TABLE 2

| | | Toner quality | | | |
|---|---|---|---|---|---|
| | Toner | Minimum scratch temperature (° C.) | Cleaning failure | Cold offset resistance | Hot offset resistance |
| Ex. 1 | 1 | B | A | A | A |
| Ex. 2 | 2 | B | A | B | B |
| Ex. 3 | 3 | B | B | B | A |
| Ex. 4 | 4 | C | B | C | B |
| Ex. 5 | 5 | C | B | A | A |
| Ex. 6 | 6 | C | B | B | B |
| Ex. 7 | 7 | C | B | B | C |
| Ex. 8 | 8 | C | B | A | A |
| Ex. 9 | 9 | B | B | B | B |
| Ex. 10 | 10 | C | B | A | A |
| Ex. 11 | 11 | C | B | A | A |
| Ex. 12 | 12 | C | C | B | B |
| Comp. Ex. 1 | 13 | B | B | B | D |
| Comp. Ex. 2 | 14 | B | B | D | B |
| Comp. Ex. 3 | 15 | B | D | B | B |
| Comp. Ex. 4 | 16 | D | C | B | B |
| Comp. Ex. 5 | 17 | C | B | D | C |
| Comp. Ex. 6 | 18 | C | C | D | C |
| Comp. Ex. 7 | 19 | B | D | B | B |
| Comp. Ex. 8 | 20 | D | B | B | B |

Aspects of the present disclosure are as follows, for example.

<1> A toner for electrostatic charge image development, wherein a spin-spin relaxation time of the toner at 90° C. is 0.30 msec or more but 1.50 msec or less, and a spin-spin relaxation time of the toner at 50° C. is 0.0185 msec or more but 0.0300 msec or less, the spin-spin relaxation time of the toner at 90° C. and the spin-spin relaxation time of the toner at 50° C. being obtained by Hahn echo method of pulse NMR analysis.

<2> The toner for electrostatic charge image development according to <1>, wherein the spin-spin relaxation time of the toner at 90° C. is 1.0 msec or more but 1.5 msec or less.

<3> The toner for electrostatic charge image development according to <1> or <2>, further including:

a non-crystalline polyester resin; and a crystalline polyester resin.

<4> The toner for electrostatic charge image development according to <3>, wherein the toner has a domain-matrix structure in which the non-crystalline polyester resin is a matrix and the crystalline polyester resin is a domain.

<5> The toner for electrostatic charge image development according to <4>, wherein a diameter of the domain of the crystalline polyester resin is 0.10 μm or more but 1.0 μm or less.

<6> The toner for electrostatic charge image development according to any one of <3> to <5>, wherein a coverage rate of the crystalline polyester resin on a surface of the toner is less than 20%, the coverage rate being determined by observing a cross section of the toner.

<7> The toner for electrostatic charge image development according to any one of <3> to <6>, wherein an amount of the crystalline polyester resin is 1% by mass or more but 20% by mass or less relative to an amount of the toner.

<8> A toner stored unit including:

a unit; and the toner according to any one of <1> to <7> stored in the unit.

<9> An image forming apparatus including:

an electrostatic latent image bearer;

an electrostatic latent image forming unit configured to form an electrostatic latent image on the electrostatic latent image bearer; and a developing unit including a toner and configured to develop, using the toner, the electrostatic latent image formed on the electrostatic latent image bearer, to form a toner image, wherein the toner is the toner for electrostatic charge image development according to any one of <1> to <7>.

<10> An image forming method including:

forming an electrostatic latent image on an electrostatic latent image bearer; and developing, using a toner, the electrostatic latent image formed on the electrostatic latent image bearer, to form a toner image, wherein the toner is the toner for electrostatic charge image development according to any one of <1> to <7>.

The toners for electrostatic charge image development according to <1> to <7>, the toner stored unit according to <8>, the image forming apparatus according to <9>, and the image forming method according to <10> can solve the conventionally existing problems and can achieve the object of the present disclosure.

What is claimed is:

1. A toner for electrostatic charge image development, wherein a spin-spin relaxation time of the toner at 90° C. is 0.30 msec or more but 1.50 msec or less, and a spin-spin relaxation time of the toner at 50° C. is 0.0185 msec or more but 0.0300 msec or less, the spin-spin relaxation time of the toner at 90° C. and the spin-spin relaxation time of the toner at 50° C. being obtained by Hahn echo method of pulse NMR analysis, wherein the toner comprises a non-crystalline polyester resin and a crystalline polyester resin, wherein the toner has a domain-matrix structure in which the non-crystalline polyester resin is a matrix, and the crystalline polyester resin is a domain, and wherein an amount of the crystalline polyester resin is 10% by mass or more but 20% by mass or less relative to an amount of the toner.

2. The toner for electrostatic charge image development according to claim 1, wherein the spin-spin relaxation time of the toner at 90° C. is 1.0 msec or more but 1.5 msec or less.

3. The toner for electrostatic charge image development according to claim 1, wherein a diameter of the domain of the crystalline polyester resin is 0.50 μm or more but 1.5 μm or less.

4. The toner for electrostatic charge image development according to claim 1, wherein a coverage rate of the crystalline polyester resin on a surface of the toner is less than 20%, the coverage rate being determined by observing a cross section of the toner.

5. A toner stored unit, comprising:

a unit; and the toner according to claim 1 stored in the unit.

6. An image forming apparatus, comprising:

an electrostatic latent image bearer;

an electrostatic latent image forming unit configured to form an electrostatic latent image on the electrostatic latent image bearer; and a developing unit including a toner and configured to develop, using the toner, the electrostatic latent image formed on the electrostatic latent image bearer, to form a toner image, wherein the toner is a toner for electrostatic charge image development, wherein a spin-spin relaxation time of the toner at 90° C. is 0.30 msec or more but 1.50 msec or less, and a spin-spin relaxation time of the toner at 50° C. is 0.0185 msec or more but 0.0300 msec or less, the spin-spin relaxation time of the toner at 90° C. and the spin-spin relaxation time of the toner at 50° C. being obtained by Hahn echo method of pulse NMR analysis, wherein the toner comprises a non-crystalline polyester resin and a crystalline polyester resin, and wherein the toner has a domain-matrix structure in which the non-crystalline polyester resin is a matrix, and the crystalline polyester resin is a domain, and wherein an amount of the crystalline polyester resin is 10% by mass or more but 20% by mass or less relative to an amount of the toner.

7. An image forming method, comprising:

forming an electrostatic latent image on an electrostatic latent image bearer; and developing, using a toner, the electrostatic latent image formed on the electrostatic latent image bearer, to form a toner image, wherein the toner is a toner for electrostatic charge image development, wherein a spin-spin relaxation time of the toner at 90° C. is 0.30 msec or more but 1.50 msec or less, and a spin-spin relaxation time of the toner at 50° C. is 0.0185 msec or more but 0.0300 msec or less, the spin-spin relaxation time of the toner at 90° C. and the spin-spin relaxation time of the toner at 50° C. being obtained by Hahn echo method of pulse NMR analysis, wherein the toner comprises a non-crystalline polyester resin and a crystalline polyester resin, and wherein the toner has a domain-matrix structure in which the non-crystalline polyester resin is a matrix, and the crystalline polyester resin is a domain, and wherein an amount of the crystalline polyester resin is 10% by mass or more but 20% by mass or less relative to an amount of the toner.

8. The toner according to claim 1, wherein the crystalline polyester resin is homogeneously dispersed in the form of fine domains in the non-crystalline polyester resin.

9. The toner according to claim 1, wherein the crystalline polyester resin has a melting point of 50 degrees C. or more but 100 degrees C. or less.

10. The toner for electrostatic charge image development according to claim 1, wherein an amount of the crystalline polyester resin is 10% by mass or more but 18% by mass or less relative to an amount of the toner.

11. The toner for electrostatic charge image development according to claim 3, wherein a coverage rate of the crystalline polyester resin on a surface of the toner is less than 20%, the coverage rate being determined by observing a cross section of the toner.

12. The toner for electrostatic charge image development according to claim 1, wherein the spin-spin relaxation time of the toner at 50° C. is 0.0200 msec or more but 0.0250 msec or less.

13. The toner for electrostatic charge image development according to claim 1, wherein the resins of the toner are subjected to an annealing treatment.

14. The toner for electrostatic charge image development according to claim 1, further comprising a release agent.

15. The toner for electrostatic charge image development according to claim 14, wherein the release agent comprises a wax.

* * * * *